US008899334B2

(12) United States Patent
Merron et al.

(10) Patent No.: US 8,899,334 B2
(45) Date of Patent: Dec. 2, 2014

(54) SYSTEM AND METHOD FOR SERVICING A WELLBORE

(75) Inventors: Matthew James Merron, Dallas, TX (US); Matt T. Howell, Duncan, OK (US); Jesse Cale Porter, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 457 days.

(21) Appl. No.: 13/215,553

(22) Filed: Aug. 23, 2011

(65) Prior Publication Data

US 2013/0048298 A1 Feb. 28, 2013

(51) Int. Cl.

| | |
|---|---|
| ***E21B 34/06*** | (2006.01) |
| ***E21B 34/10*** | (2006.01) |
| ***E21B 34/14*** | (2006.01) |
| *E21B 34/00* | (2006.01) |

(52) U.S. Cl.

CPC ..... *E21B 34/103* (2013.01); *E21B 34/14* (2013.01); *E21B 2034/007* (2013.01)

USPC ..... 166/373; 166/383; 166/386; 166/323

(58) Field of Classification Search

USPC ..... 166/373, 374, 383, 386, 323

See application file for complete search history.

(56) References Cited

U.S. PATENT DOCUMENTS

| | | | |
|---|---|---|---|
| 2,201,290 | A | 5/1940 | Greene |
| 2,493,650 | A | 1/1950 | Baker et al. |
| 2,537,066 | A | 1/1951 | Lewis |
| 2,627,314 | A | 2/1953 | Baker et al. |
| 2,913,051 | A | 11/1959 | Lister |
| 3,054,415 | A | 9/1962 | Baker et al. |
| 3,057,405 | A | 10/1962 | Mallinger |
| 3,151,681 | A | 10/1964 | Cochran |

(Continued)

FOREIGN PATENT DOCUMENTS

| | | | |
|---|---|---|---|
| AU | 2012200380 | A1 | 2/2012 |
| CA | 2778311 | A1 | 5/2011 |

(Continued)

OTHER PUBLICATIONS

Foreign communication from a related counterpart application—International Search Report and Written Opinion, PCT/US2013/035122, Dec. 18, 2013, 13 pages.

(Continued)

*Primary Examiner* — Cathleen Hutchins

(74) *Attorney, Agent, or Firm* — John Wustenberg; Conley Rose, P.C.

(57) ABSTRACT

A wellbore servicing apparatus, comprising a housing defining an axial flowbore and comprising ports, a first sleeve, a second sleeve movable relative to the housing from (a) a first position in which the second sleeve obstructs fluid communication via the ports of the housing to (b) a second position in which the second sleeve allows fluid communication via the ports of the housing, and wherein the first sleeve is movable relative to the housing from (a) a first position in which the first sleeve does not allow a fluid pressure applied to the axial flowbore to move the second sleeve from the first position to the second position to (b) a second position in which the first sleeve allows a fluid pressure applied to the axial flowbore to move the second sleeve from the first position to the second position, and an expandable seat.

21 Claims, 6 Drawing Sheets

(56) References Cited

U.S. PATENT DOCUMENTS 3,216,497 A 11/1965 Howard et al.
3,295,607 A 1/1967 Sutliff
3,363,696 A 1/1968 Berryman
3,434,537 A 3/1969 Zandmer
3,662,825 A 5/1972 Nutter
3,662,826 A 5/1972 Young et al.
3,768,556 A 10/1973 Baker
3,850,238 A 11/1974 Hill
4,047,564 A 9/1977 Nix et al.
4,081,990 A 4/1978 Chatagnier
4,105,069 A 8/1978 Baker
4,109,725 A 8/1978 Williamson et al.
4,150,994 A 4/1979 Maternaghan
4,196,782 A 4/1980 Blanton
4,373,582 A 2/1983 Bednar et al.
4,417,622 A 11/1983 Hyde
4,469,136 A 9/1984 Watkins
4,605,074 A 8/1986 Barfield
4,673,039 A 6/1987 Mohaupt
4,691,779 A 9/1987 McMahan et al.
4,714,117 A 12/1987 Dech
4,771,831 A 9/1988 Pringle et al.
4,842,062 A 6/1989 Schneider et al.
4,893,678 A 1/1990 Stokley et al.
5,125,582 A 6/1992 Surjaatmadja et al.
5,127,472 A 7/1992 Watson et al.
5,137,086 A 8/1992 Stokley et al.
5,156,220 A 10/1992 Forehand et al.
5,180,016 A 1/1993 Ross et al.
5,193,621 A 3/1993 Manke et al.
5,289,875 A 3/1994 Stokley et al.
5,314,032 A 5/1994 Pringle et al.
5,323,856 A 6/1994 Davis et al.
5,325,917 A 7/1994 Szarka
5,325,923 A 7/1994 Surjaatmadja et al.
5,361,856 A 11/1994 Surjaatmadja et al.
5,366,015 A 11/1994 Surjaatmadja et al.
5,375,662 A 12/1994 Echols, III et al.
5,381,862 A 1/1995 Szarka et al.
5,396,957 A 3/1995 Surjaatmadja et al.
5,425,424 A 6/1995 Reinhardt et al.
5,484,016 A 1/1996 Surjaatmadja et al.
5,494,103 A 2/1996 Surjaatmadja et al.
5,494,107 A 2/1996 Bode
5,499,678 A 3/1996 Surjaatmadja et al.
5,499,687 A 3/1996 Lee
5,533,571 A 7/1996 Surjaatmadja et al.
5,558,153 A 9/1996 Holcombe et al.
5,732,776 A 3/1998 Tubel et al.
5,765,642 A 6/1998 Surjaatmadja
5,826,661 A 10/1998 Parker et al.
5,865,252 A 2/1999 Van Petegem et al.
5,865,254 A 2/1999 Huber et al.
5,927,401 A 7/1999 Morris et al.
5,944,105 A 8/1999 Nguyen
5,947,198 A 9/1999 McKee et al.
5,947,205 A 9/1999 Shy
5,960,881 A 10/1999 Allamon et al.
6,000,468 A 12/1999 Pringle
6,003,834 A 12/1999 Read
6,006,838 A 12/1999 Whiteley et al.
6,041,864 A 3/2000 Patel et al.
6,116,343 A 9/2000 Van Petegem et al.
6,119,783 A 9/2000 Parker et al.
6,145,593 A 11/2000 Hennig
6,152,232 A 11/2000 Webb et al.
6,167,974 B1 1/2001 Webb
6,189,618 B1 2/2001 Beeman et al.
6,216,785 B1 4/2001 Achee, Jr. et al.
6,230,811 B1 5/2001 Ringgenberg et al.
6,241,015 B1 6/2001 Pringle et al.
6,244,342 B1 6/2001 Sullaway et al.
6,253,861 B1 7/2001 Carmichael et al.
6,257,339 B1 * 7/2001 Haugen et al. ..... 166/387
6,286,599 B1 9/2001 Surjaatmadja et al.
6,318,469 B1 11/2001 Patel
6,318,470 B1 11/2001 Chang et al.
6,336,502 B1 1/2002 Surjaatmadja et al.
6,343,658 B2 2/2002 Webb
6,359,569 B2 3/2002 Beck et al.
6,422,317 B1 7/2002 Williamson, Jr.
6,453,997 B1 9/2002 McNeilly et al.
6,467,541 B1 10/2002 Wells
6,494,264 B2 12/2002 Pringle et al.
6,520,257 B2 2/2003 Allamon et al.
6,543,538 B2 4/2003 Tolman et al.
6,561,277 B2 5/2003 Algeroy et al.
6,571,875 B2 6/2003 Bissonnette et al.
6,634,428 B2 10/2003 Krauss et al.
6,662,874 B2 12/2003 Surjaatmadja et al.
6,662,877 B2 12/2003 Patel
6,712,160 B1 3/2004 Schultz et al.
6,719,054 B2 4/2004 Cheng et al.
6,722,427 B2 4/2004 Gano et al.
6,725,933 B2 4/2004 Middaugh et al.
6,769,490 B2 8/2004 Allamon et al.
6,776,238 B2 8/2004 Dusterhoft et al.
6,779,607 B2 8/2004 Middaugh et al.
6,787,758 B2 9/2004 Tubel et al.
6,789,619 B2 9/2004 Carlson et al.
6,802,374 B2 10/2004 Edgar et al.
6,907,936 B2 6/2005 Fehr et al.
6,923,255 B2 8/2005 Lee
6,938,690 B2 9/2005 Surjaatmadja
6,997,252 B2 2/2006 Porter et al.
6,997,263 B2 2/2006 Campbell et al.
7,013,971 B2 3/2006 Griffith et al.
7,021,384 B2 4/2006 Themig
7,021,389 B2 4/2006 Bishop et al.
7,055,598 B2 6/2006 Ross et al.
7,066,265 B2 6/2006 Surjaatmadja
7,090,153 B2 8/2006 King et al.
7,096,954 B2 8/2006 Weng et al.
7,108,067 B2 9/2006 Themig et al.
7,134,505 B2 11/2006 Fehr et al.
7,159,660 B2 1/2007 Justus
7,168,493 B2 1/2007 Eddison
7,195,067 B2 3/2007 Manke et al.
7,219,730 B2 5/2007 Tilton et al.
7,225,869 B2 6/2007 Willett et al.
7,228,908 B2 6/2007 East, Jr. et al.
7,234,529 B2 6/2007 Surjaatmadja
7,237,612 B2 7/2007 Surjaatmadja et al.
7,243,723 B2 7/2007 Surjaatmadja et al.
7,252,147 B2 8/2007 Badalamenti et al.
7,252,152 B2 8/2007 LoGiudice et al.
7,273,099 B2 9/2007 East, Jr. et al.
7,278,486 B2 10/2007 Alba et al.
7,287,592 B2 10/2007 Surjaatmadja et al.
7,290,611 B2 11/2007 Badalamenti et al.
7,296,625 B2 11/2007 East, Jr.
7,303,008 B2 12/2007 Badalamenti et al.
7,306,043 B2 12/2007 Toekje et al.
7,322,412 B2 1/2008 Badalamenti et al.
7,322,417 B2 1/2008 Rytlewski et al.
7,325,617 B2 2/2008 Murray
7,337,844 B2 3/2008 Surjaatmadja et al.
7,337,847 B2 3/2008 McGarian et al.
7,343,975 B2 3/2008 Surjaatmadja et al.
7,353,878 B2 4/2008 Themig
7,353,879 B2 4/2008 Todd et al.
7,367,393 B2 5/2008 Vachon
7,377,321 B2 5/2008 Rytlewski
7,377,322 B2 5/2008 Hofman
7,385,523 B2 6/2008 Thomeer et al.
7,387,165 B2 6/2008 Lopez de Cardenas et al.
7,398,825 B2 7/2008 Nguyen et al.
7,416,029 B2 8/2008 Telfer et al.
7,419,002 B2 9/2008 Dybevik et al.
7,422,060 B2 9/2008 Hammami et al.
7,431,090 B2 10/2008 Surjaatmadja et al.
7,431,091 B2 10/2008 Themig et al.
7,464,764 B2 12/2008 Xu
7,478,676 B2 1/2009 East, Jr. et al.

(56) References Cited

U.S. PATENT DOCUMENTS

| | | | |
|---|---|---|---|
| 7,503,390 | B2 | 3/2009 | Gomez |
| 7,503,398 | B2 | 3/2009 | LoGiudice et al. |
| 7,506,689 | B2 | 3/2009 | Surjaatmadja et al. |
| 7,510,010 | B2 | 3/2009 | Williamson |
| 7,510,017 | B2 | 3/2009 | Howell et al. |
| 7,520,327 | B2 | 4/2009 | Surjaatmadja |
| 7,527,103 | B2 | 5/2009 | Huang et al. |
| 7,543,641 | B2 | 6/2009 | Contant |
| 7,571,766 | B2 | 8/2009 | Pauls et al. |
| 7,575,062 | B2 | 8/2009 | East, Jr. |
| 7,617,871 | B2 | 11/2009 | Surjaatmadja et al. |
| 7,621,337 | B2 | 11/2009 | Badalamenti et al. |
| 7,628,213 | B2 | 12/2009 | Telfer |
| 7,637,323 | B2 | 12/2009 | Schasteen et al. |
| 7,644,772 | B2 | 1/2010 | Avant et al. |
| 7,661,478 | B2 | 2/2010 | Palmer et al. |
| 7,665,545 | B2 | 2/2010 | Telfer |
| 7,673,673 | B2 | 3/2010 | Surjaatmadja et al. |
| 7,673,677 | B2 | 3/2010 | King et al. |
| 7,681,645 | B2 | 3/2010 | McMillin et al. |
| 7,703,510 | B2 | 4/2010 | Xu |
| 7,735,559 | B2 | 6/2010 | Malone |
| 7,740,072 | B2 | 6/2010 | Surjaatmadja |
| 7,740,079 | B2 | 6/2010 | Clayton et al. |
| 7,748,460 | B2 | 7/2010 | Themig et al. |
| 7,775,285 | B2 | 8/2010 | Surjaatmadja et al. |
| 7,779,906 | B2 | 8/2010 | Porter et al. |
| 7,802,627 | B2 | 9/2010 | Hofman et al. |
| 7,849,924 | B2 | 12/2010 | Surjaatmadja et al. |
| 7,849,925 | B2 | 12/2010 | Patel |
| 7,861,788 | B2 | 1/2011 | Tips et al. |
| 7,866,396 | B2 | 1/2011 | Rytlewski |
| 7,866,402 | B2 | 1/2011 | Williamson, Jr. |
| 7,866,408 | B2 | 1/2011 | Allison et al. |
| 7,870,907 | B2 | 1/2011 | Lembcke et al. |
| 7,878,255 | B2 | 2/2011 | Howell et al. |
| 7,909,108 | B2 | 3/2011 | Swor et al. |
| 7,926,571 | B2 | 4/2011 | Hofman |
| 7,934,559 | B2 | 5/2011 | Posevina et al. |
| 7,938,186 | B1 | 5/2011 | Badalamenti et al. |
| 7,946,340 | B2 | 5/2011 | Surjaatmadja et al. |
| 7,963,331 | B2 | 6/2011 | Surjaatmadja et al. |
| 7,967,067 | B2 | 6/2011 | Irani et al. |
| 8,162,050 | B2 | 4/2012 | Roddy et al. |
| 8,186,444 | B2 | 5/2012 | Patel |
| 8,191,625 | B2 | 6/2012 | Porter et al. |
| 8,215,411 | B2 | 7/2012 | Flores et al. |
| 8,245,788 | B2 | 8/2012 | Garcia et al. |
| 8,267,178 | B1 | 9/2012 | Sommers et al. |
| 8,276,674 | B2 | 10/2012 | Lopez De Cardenas et al. |
| 8,276,675 | B2 | 10/2012 | Williamson et al. |
| 8,291,980 | B2 | 10/2012 | Fay |
| 8,297,367 | B2 | 10/2012 | Chen et al. |
| 8,307,913 | B2 | 11/2012 | Dolman et al. |
| 8,316,951 | B2 | 11/2012 | Fay et al. |
| 8,365,824 | B2 | 2/2013 | Phillips |
| 8,408,314 | B2 | 4/2013 | Patel et al. |
| 8,418,769 | B2 | 4/2013 | Fay et al. |
| 8,496,055 | B2 | 7/2013 | Mootoo et al. |
| 8,505,639 | B2 | 8/2013 | Robison et al. |
| 8,534,369 | B2 | 9/2013 | deBoer |
| 8,540,035 | B2 | 9/2013 | Xu et al. |
| 8,757,265 | B1 | 6/2014 | Cuffe et al. |
| 2003/0029611 | A1 | 2/2003 | Owens |
| 2006/0086507 | A1 | 4/2006 | Surjaatmadja et al. |
| 2006/0157257 | A1 | 7/2006 | Ross et al. |
| 2007/0102156 | A1 | 5/2007 | Nguyen et al. |
| 2007/0261851 | A1 | 11/2007 | Surjaatmadja |
| 2007/0272411 | A1 | 11/2007 | Lopez De Cardenas et al. |
| 2007/0272413 | A1 | 11/2007 | Rytlewski et al. |
| 2007/0284114 | A1 | 12/2007 | Swor et al. |
| 2008/0000637 | A1 | 1/2008 | McDaniel et al. |
| 2008/0060810 | A9 | 3/2008 | Nguyen et al. |
| 2008/0135248 | A1 | 6/2008 | Talley et al. |
| 2008/0202764 | A1 | 8/2008 | Clayton et al. |
| 2008/0264641 | A1 | 10/2008 | Slabaugh et al. |
| 2009/0084553 | A1 | 4/2009 | Rytlewski et al. |
| 2009/0090501 | A1 | 4/2009 | Hansen et al. |
| 2009/0223670 | A1 | 9/2009 | Snider |
| 2009/0308588 | A1 | 12/2009 | Howell et al. |
| 2010/0000727 | A1 | 1/2010 | Webb et al. |
| 2010/0044041 | A1 | 2/2010 | Smith et al. |
| 2010/0155055 | A1 | 6/2010 | Ash et al. |
| 2010/0200243 | A1 | 8/2010 | Purkis |
| 2010/0200244 | A1 | 8/2010 | Purkis |
| 2011/0036590 | A1 | 2/2011 | Williamson et al. |
| 2011/0100643 | A1 | 5/2011 | Themig et al. |
| 2011/0108272 | A1 | 5/2011 | Watson et al. |
| 2011/0147088 | A1 | 6/2011 | Brunet et al. |
| 2011/0155380 | A1 | 6/2011 | Frazier |
| 2011/0155392 | A1 | 6/2011 | Frazier |
| 2011/0180269 | A1 | 7/2011 | Vestavik |
| 2011/0192607 | A1 | 8/2011 | Hofman et al. |
| 2011/0253383 | A1 | 10/2011 | Porter et al. |
| 2011/0278017 | A1 | 11/2011 | Themig et al. |
| 2012/0061105 | A1 | 3/2012 | Neer et al. |
| 2012/0111574 | A1 | 5/2012 | Desranleau et al. |
| 2012/0160515 | A1 | 6/2012 | Braekke et al. |
| 2013/0008647 | A1 | 1/2013 | Dirksen et al. |
| 2013/0048290 | A1 | 2/2013 | Howell et al. |
| 2013/0048291 | A1 | 2/2013 | Merron et al. |
| 2013/0048298 | A1 | 2/2013 | Merron et al. |
| 2013/0255938 | A1 | 10/2013 | Neer |

FOREIGN PATENT DOCUMENTS

| | | | |
|---|---|---|---|
| CN | 102518418 | A | 6/2012 |
| CN | 102518420 | A | 6/2012 |
| EP | 2216500 | A2 | 8/2010 |
| GB | 2321659 | A | 8/1998 |
| GB | 2323871 | A | 10/1998 |
| GB | 2332006 | A | 6/1999 |
| GB | 2415213 | B | 1/2009 |
| WO | 0246576 | A1 | 6/2002 |
| WO | 2004088091 | A1 | 10/2004 |
| WO | 2008070051 | A2 | 6/2008 |
| WO | 2008070051 | A3 | 6/2008 |
| WO | 2008070051 | B1 | 6/2008 |
| WO | 2008071912 | A1 | 6/2008 |
| WO | 2008093047 | A1 | 8/2008 |
| WO | 2009019461 | A1 | 2/2009 |
| WO | 2009029437 | A1 | 3/2009 |
| WO | 2009132462 | A1 | 11/2009 |
| WO | 2010001087 | A2 | 1/2010 |
| WO | 2010001087 | A3 | 1/2010 |
| WO | 2010058160 | A1 | 5/2010 |
| WO | 2010127457 | A1 | 11/2010 |
| WO | 2010128291 | A2 | 11/2010 |
| WO | 2010149644 | A1 | 12/2010 |
| WO | 2011018623 | A2 | 2/2011 |
| WO | 2011018623 | A3 | 2/2011 |
| WO | 2011058325 | A2 | 5/2011 |
| WO | 2011058325 | A3 | 5/2011 |
| WO | 2012037646 | A1 | 3/2012 |
| WO | 2012107730 | A2 | 8/2012 |
| WO | 2012107730 | A3 | 8/2012 |
| WO | 2012107730 | A8 | 8/2012 |
| WO | 2012107731 | A2 | 8/2012 |
| WO | 2012107731 | A3 | 8/2012 |
| WO | 2012164236 | A1 | 12/2012 |
| WO | 2013028385 | A2 | 2/2013 |
| WO | 2013028385 | A3 | 2/2013 |
| WO | 2013048696 | A1 | 4/2013 |
| WO | 2013165643 | A2 | 11/2013 |
| WO | 2013165643 | A3 | 11/2013 |
| WO | 2014004144 | A2 | 1/2014 |

OTHER PUBLICATIONS

Foreign communication from a related counterpart application—International Search Report and Written Opinion, PCT/US2013/046109, Dec. 18, 2013, 10 pages.

(56) References Cited

OTHER PUBLICATIONS

"Omega Tracer Deployment Valve (TDV)," XP054975262, Oct. 2, 2009, 1 page, http://www.youtube.com/watch?v=9nBh22_7EfA, Omega Completion Technology, Ltd.
Foreign communication from a related counterpart application—International Preliminary Report on Patentability, PCT/GB2012/000140, Dec. 2, 2013, 6 pages.
Office Action dated Mar. 28, 2012 (39 pages), U.S. Appl. No. 12/617,405, filed Nov. 12, 2009.
Office Action dated Apr. 4, 2012 (21 pages), U.S. Appl. No. 12/539,392, filed Aug. 11, 2009.
Patent application entitled "Responsively activated wellbore stimulation assemblies and methods of using the same," by William Mark Norrid, et al., filed Sep. 29, 2011 as U.S. Appl. No. 13/248,145.
Patent application entitled "Delayed activation activatable stimulation assembly," by Matthew James Merron, filed Apr. 30, 2012 as U.S. Appl. No. 13/460,453.
Office Action dated May 8, 2013 (51 pages), U.S. Appl. No. 13/025,039, filed Feb. 10, 2011.
Foreign communication from a related counterpart application—International Search Report and Written Opinion, PCT/GB2012/000140, May 30, 2012, 11 pages.
Patent application entitled "System and Method for Servicing a Wellbore," by Adam Kent Neer, filed Jun. 29, 2012 as U.S. Appl. No. 13/538,911.
Notice of Allowance dated Jul. 9, 2012 (11 pages), U.S. Appl. No. 12/617,405, filed Nov. 12, 2009.
Notice of Allowance dated Jul. 25, 2012 (9 pages), U.S. Appl. No. 12/539,392, filed Aug. 11, 2009.
Supplemental Notice of Allowability dated Aug. 22, 2012 (6 pages), U.S. Appl. No. 12/539,392 filed Aug. 11, 2009.
Foreign communication from a related counterpart application—International Search Report and Written Opinion, PCT/GB2012/000141, Dec. 20, 2012, 11 pages.
Foreign communication from a related counterpart application—International Search Report and Written Opinion, PCT/GB2008/002646, Dec. 11, 2008, 8 pages.
Foreign Communication from a related counterpart application—International Search Report and Written Opinion, PCT/GB2007/004628, Feb. 26, 2008, 8 pages.
Foreign commuunication from a related counterpart application—International Search Report and Written Opinion, PCT/GB2009/001505, Feb. 8, 2011, 8 pages.
Foreign communication from a related counterpart application—International Search Report and Written Opinion, PCT/GB2009/002693, Mar. 2, 2010, 8 pages.
Foreign communication from a related counterpart application—International Search Report and Written Opinion, PCT/GB2010/001524, Apr. 13, 2011, 11 pages.
Foreign communication from a related counterpart application—International Search Report and Written Opinion, PCT/GB2010/002090, Aug. 12, 2011, 11 pages.
Halliburton brochure entitled "Delta Stim® Completion Service," Sep. 2008, 4 pages, Halliburton.
Halliburton brochure entitled "Delta Stim™ Sleeve," Mar. 2007, 2 pages, Halliburton.
Halliburton brochure entitled "Swellpacker® cable system," Aug. 2008, 2 pages, Halliburton.
Halliburton brochure entitled "RapidFrac™ System," Mar. 2011, 3 pages.
Halliburton brochure entitled "sFrac™ Valve," Jun. 2010, 3 pages, Halliburton.
Halliburton Marketing Data Sheet, Sand Control, EquiFlow™ Inflow Control Devices, HO5600,01/08, pp. 1-2.
The Lee Company brochure entitled "Meet the EFS family," http://www.theleeco.com/EFSWEB2.NSF/Products!OpenPage, Apr. 21, 2009, 1 page.
The Lee Company brochure entitled "Meet the precision microhydraulics family," http://www.theleeco.com/LEEWEB2.NSF/AeroStart!OpenPage, Apr. 21, 2009, 2 pages.
Lohm calculator for gas flow, http://www.theleeco.com/EFSWEB2.NSF/airlohms.htm, Apr. 21, 2009, 2 pages, courtesy of The Lee Company.
Lohm calculator for liquid flow, http://www.theleeco.com/EFSWEB2.NSF/flowcalc.htm, Apr. 21, 2009, 2 pages, courtesy of The Lee Company.
Office Action (Final) dated Sep. 15, 2009 (12 pages), U.S. Appl. No. 11/609,128, filed Dec. 11, 2006.
Office Action dated Feb. 18, 2009 (18 pages), U.S. Appl. No. 11/609,128, filed Dec. 11, 2006.
Office Action dated Jun. 24, 2010 (13 pages), U.S. Appl. No. 12/139,604, filed Jun. 16, 2008.
Office Action dated Dec. 22, 2009 (18 pages), U.S. Appl. No. 12/139,604, filed Jun. 16, 2008.
Office Action (Final) dated Aug. 12, 2011 (12 pages), U.S. Appl. No. 12/166,257, filed Jul. 1, 2008.
Office Action dated Mar. 31, 2011 (19 pages), U.S. Appl. No. 12/166,257, filed Jul. 1, 2008.
Office Action dated Aug. 9, 2011 (24 pages), U.S. Appl. No. 12/539,392, filed Aug. 11, 2009.
Packers Plus brochure entitled "Achieve immediate production; StackFRAC® HD," Mar. 11, 2011, 4 pages.
Patent application entitled "A Method for individually servicing a plurality of zones of a subterranean formation," by Matthew Todd Howell, filed Feb. 10, 2011 as U.S. Appl. No. 13/025,039.
Patent application entitled "System and method for servicing a wellbore," by Jesse Cale Porter, et al., filed Feb. 10, 2011 as U.S. Appl. No. 13/025,041.
Patent application entitled "System and method for servicing a wellbore," by Jesse Cale Porter, et al., filed Jun. 2, 2011 as U.S. Appl. No. 13/151,457.
Patent application entitled "Responsively activated wellbore stimulation assemblies and methods of using the same," by Brock William Miller, filed Jun. 8, 2011 as U.S. Appl. No. 13/156,155.
Packers Plus® Case Study entitled "Packers Plus launches the StackFRAC® HD "High Density" Multi-Stage Fracturing System to fulfill operator demand for more stimulation stages to increase production," 1 page.
Packers Plus brochure entitled "High Density Multi-Stage Fracturing System; StackFRAC® HD," Apr. 20, 2010, 2 pages.
Foreign communication from a related counterpart application—Invitation to Pay Additional Fees, PCT/US2012/050564, Nov. 5, 2013, 4 pages.
Office Action dated Jun. 18, 2013 (41 pages), U.S. Appl. No. 13/025,041, filed Feb. 10, 2011.
Office Action dated Jun. 18, 2013 (40 pages), U.S. Appl. No. 13/151,457, filed Jun. 2, 2011.
Foreign communication from a related counterpart application—International Search Report and Written Opinion, PCT/GB2012/000139, Dec. 19, 2012, 11 pages.
Foreign communication from a related counterpart application—International Search Report and Written Opinion, PCT/US2012/054161, Feb. 8, 2013, 11 pages.
Office Action (Final) dated Oct. 11, 2013 (17 pages), U.S. Appl. No. 13/025,039, filed Feb. 10, 2011.
Foreign communication from a related counterpart application—International Preliminary Report on Patentability, PCT/GB2008/002646, Feb. 9, 2010, 6 pages.
Foreign communication from a related counterpart application—International Preliminary Report on Patentability, PCT/GB2007/004628, Jun. 16, 2009, 6 pages.
Foreign communication from a related counterpart application—International Preliminary Report on Patentability, PCT/GB2009/001505, Feb. 15, 2011, 5 pages.
Foreign communication from a related counterpart application—International Preliminary Report on Patentability, PCT/GB2009/002693, May 24, 2011, 6 pages.
Foreign communication from a related counterpart application—International Preliminary Report on Patentability, PCT/GB2010/001524, Feb. 14, 2012, 7 pages.
Foreign communication from a related counterpart application—International Preliminary Report on Patentability, PCT/GB2010/002090, May 15, 2012, 8 pages.

(56) References Cited

OTHER PUBLICATIONS

Foreign communication from a related counterpart application—International Preliminary Report on Patentability, PCT/GB2012/000139, Aug. 13, 2013, 6 pages.
Foreign communication from a related counterpart application—International Preliminary Report on Patentability, PCT/GB2012/000141, Aug. 13, 2013, 7 pages.
Filing receipt and specification entitled "System and Method for Servicing a Wellbore," by Jesse Cale Porter, et al., filed Jan. 15, 2014 as U.S. Appl. No. 14/156,232.
Foreign communication from a related counterpart application—International Search Report and Written Opinion, PCT/US2012/050564, Feb. 14, 2014, 16 pages.
Office Action dated Feb. 25, 2014 (79 pages), U.S. Appl. No. 13/156,155, filed Jun. 8, 2011.
Filing receipt and specification entitled "A Method for Individually Servicing a Plurality of Zones of a Subterranean Formation," by Matthew Todd Howell, filed Feb. 24, 2014 as U.S. Appl. No. 14/187,761.
Office Action dated Jul. 30, 2014 (99 pages), U.S. Appl. No. 13/538,911, filed Jun. 29, 2012.
Notice of Allowance dated Aug. 11, 2014 (20 pages), U.S. Appl. No. 13/156,155, filed Jun. 8, 2011.
Office Action dated Aug. 21, 2014 (69 pages), U.S. Appl. No. 13/460,453, filed Apr. 30, 2012.
Foreign communication from a related counterpart application—Chinese Office Action with English translation, Application No. 201080059511.0, Mar. 5, 2014, 21 pages.
Foreign communication from a related counterpart application—Australian Examination Report, Application No. 2010317706, May 21, 2014, 4 pages.
Foreign communication from a related counterpart application—Canadian Office Action, CA 2,768,756, Apr. 24, 2014, 2 pages.
Foreign communication from a related counterpart application—International Search Report and Written Opinion, PCT/GB2010/001524, Apr. 13, 2011, 10 pages.
Foreign communication from a related counterpart application—International Preliminary Report on Patentability, PCT/US2012/054161, Apr. 1, 2014, 6 pages.

* cited by examiner 200
211
260
260b
267
210
260c
216b
216c
260d
261
216
260e
269
267
260f
215
264
264a
240b
240
264b
267
268
247
216a
260a
220
241
247
214b
240d
245
214c
240c
214
240f
240h
214a
240g
280c
248
240e
240a
280
280a
280b
280d 200
211
260
260b
267
210
260c
216b
216c
260d
261
216
260e
269
267
260f
240b
240
264a
215
240d
247
264b
267
268
247
245
241
216a
260a
220
240h
240c
214b
240f
240a
240g
214c
240e
280
214
280a
280c
214a
280d
211
280b

SYSTEM AND METHOD FOR SERVICING A WELLBORE

CROSS-REFERENCE TO RELATED APPLICATIONS

This application is related to commonly owned U.S. patent application Ser. No. 12/539,392 entitled "System and method for servicing a wellbore," by Jimmie Robert Williamson, et al., filed Aug. 11, 2009.

This application is related to commonly owned U.S. patent application Ser. No. 13/025,041 entitled "System and method for servicing a wellbore," by Porter, et al., filed Feb. 10, 2011; this application is also related to commonly owned U.S. patent application Ser. No. 13/025,039 entitled "A method for individually servicing a plurality of zones of a subterranean formation," by Howell, filed Feb. 10, 2011, each of which is incorporated by reference herein.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

Subterranean formations that contain hydrocarbons are sometimes non-homogeneous in their composition along the length of wellbores that extend into such formations. It is sometimes desirable to treat and/or otherwise manage the differing formation zones differently. In order to adequately induce the formation of fractures within such zones, it may be advantageous to introduce a stimulation fluid simultaneously via multiple stimulation assemblies. To accomplish this, it is necessary to configure multiple stimulation assemblies for the simultaneous communication of fluid via those stimulation assemblies. However prior art apparatuses, systems, methods have failed to efficiently and effectively so-configure multiple stimulation assemblies.

Accordingly, there exists a need for improved systems and methods of treating multiple zones of a wellbore.

SUMMARY

Disclosed herein is an activatable wellbore servicing apparatus, comprising a housing, the housing generally defining an axial flowbore and comprising one or more ports, a first sliding sleeve, a second sliding sleeve, wherein the second sliding sleeve is movable relative to the housing from (a) a first position in which the second sliding sleeve obstructs fluid communication from the axial flowbore to an exterior of the housing via the one or more ports of the housing to (b) a second position in which the second sliding sleeve allows fluid communication from the axial flowbore to the exterior of the housing via the one or more ports of the housing, and wherein the first sliding sleeve is movable relative to the housing from (a) a first position in which the first sliding sleeve does not allow a fluid pressure applied to the axial flowbore to move the second sliding sleeve from the first position to the second position to (b) a second position in which the first sliding sleeve allows a fluid pressure applied to the axial flowbore to move the second sliding sleeve from the first position to the second position, and an expandable seat.

Also disclosed herein is a system for servicing a wellbore comprising a workstring disposed within the wellbore, the workstring comprising a first wellbore servicing apparatus, comprising a first housing, the first housing generally defining a first axial flowbore and comprising a first one or more ports, a first sliding sleeve, a second sliding sleeve, wherein the second sliding sleeve is movable relative to the first housing from (a) a first position in which the second sliding sleeve obstructs fluid communication from the first axial flowbore to an exterior of the first housing via the first one or more ports of the first housing to (b) a second position in which the second sliding sleeve allows fluid communication from the first axial flowbore to the exterior of the first housing via the first one or more ports of the first housing, and wherein the first sliding sleeve is movable relative to the first housing from (a) a first position in which the first sliding sleeve does not allow a fluid pressure applied to the first axial flowbore to move the second sliding sleeve from the first position to the second position to (b) a second position in which the first sliding sleeve allows a fluid pressure applied to the first axial flowbore to move the second sliding sleeve from the first position to the second position, and an expandable seat being movable between (a) a first position in which the expandable seat is retained in a narrow conformation and (b) a second position in which the expandable seat is allowed to expand into an expanded conformation, and a second wellbore servicing apparatus, comprising a second housing, the second housing generally defining a second axial flowbore and comprising a second one or more ports, a third sliding sleeve, a fourth sliding sleeve, wherein the fourth sliding sleeve is movable relative to the second housing from (a) a first position in which the fourth sliding sleeve obstructs fluid communication from the second axial flowbore to an exterior of the second housing via the second one or more ports of the second housing to (b) a second position in which the fourth sliding sleeve allows fluid communication from the second axial flowbore to the exterior of the second housing via the second one or more ports of the housing, and wherein the third sliding sleeve is movable relative to the second housing from (a) a first position in which the third sliding sleeve does not allow a fluid pressure applied to the second axial flowbore to move the fourth sliding sleeve from the first position to the second position to (b) a second position in which the third sliding sleeve allows a fluid pressure applied to the second axial flowbore to move the fourth sliding sleeve from the first position to the second position, and a non-expandable seat being movable between (a) a first position and (b) a second position.

Further disclosed herein is a method of servicing a wellbore penetrating a subterranean formation comprising positioning a workstring with in a wellbore, the workstring substantially defining a workstring flowbore and comprising a first wellbore servicing apparatus comprising a first one or more ports, and a second wellbore servicing apparatus comprising a second one or more ports, each of the first wellbore servicing apparatus and the second wellbore servicing apparatus being transitionable from a locked mode to a delay mode and from the delay mode to an activated mode, wherein, when in both the locked mode and the delay mode, the first wellbore servicing apparatus will not communicate fluid via the first one or more ports and the second wellbore servicing apparatus will not communicate fluid via the second one or more ports, and wherein, when in the activated mode the first wellbore servicing apparatus will communicate fluid via the first one or more ports and the second wellbore servicing apparatus will communicate fluid via the second one or more ports, transitioning the first wellbore servicing apparatus and the second wellbore servicing apparatus from the locked mode to the delay mode, transitioning the first wellbore servicing apparatus and the second wellbore servicing apparatus from the delay mode to the activated mode, wherein the first wellbore servicing apparatus does not transition to the activated mode before the second wellbore servicing apparatus is in the locked mode, communicating a wellbore servicing fluid to a first zone of the subterranean formation via the first one or more ports and the second one or more ports.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
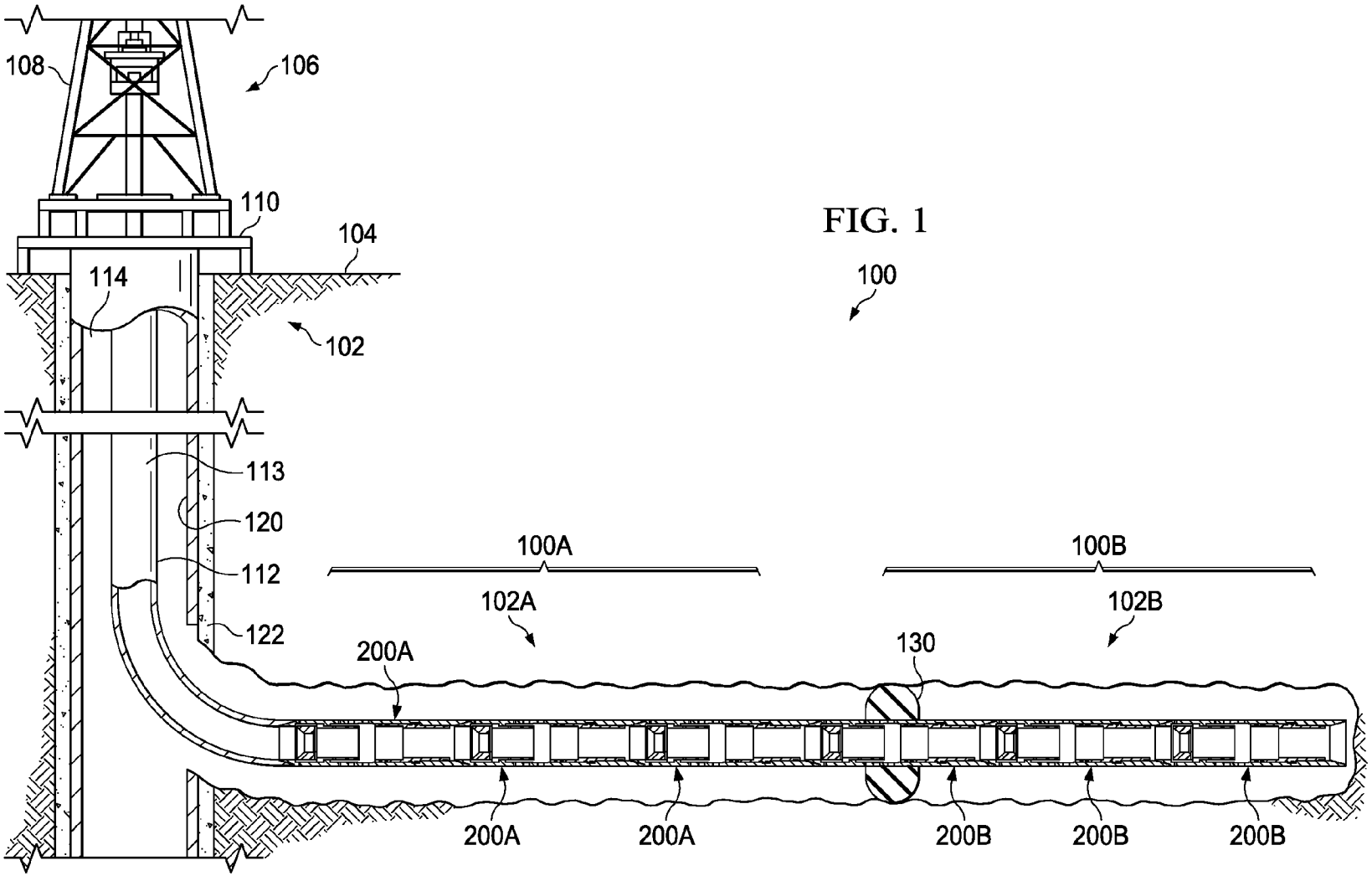
FIG. 1 is a cut-away view of an embodiment of a wellbore servicing system comprising a plurality of activatable stimulation assemblies (ASAs) according to the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems, and methods of using the same. Particularly, disclosed herein are one or more of embodiments of an activatable stimulation assembly (ASA). Also disclosed herein are one or more embodiments of a wellbore servicing system comprising a cluster of ASAs, each cluster of ASAs comprising multiple ASAs, at least one of the ASAs within a given ASA cluster being configured as a terminal ASA, as will be discussed herein, and at least one of the ASAs being configured as a non-terminal ASA, as will be disclosed herein. Also disclosed herein are one or more embodiments of a method of servicing a wellbore employing one or more ASAs.

Referring to FIG. 1, an embodiment of an operating environment in which such wellbore servicing apparatuses, systems, and methods may be employed is illustrated. It is noted that although some of the figures may exemplify horizontal or vertical wellbores, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

As depicted in FIG. 1, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 comprises a derrick 108 with a rig floor 110 through which a work string 112 (e.g., a drill string, a tool string, a segmented tubing string, a jointed tubing string, a casing string, or any other suitable conveyance, or combinations thereof) generally defining an axial flowbore 113 may be positioned within or partially within the wellbore 114. In an embodiment, the work string 112 may comprise two or more concentrically positioned strings of pipe or tubing (e.g., a first work string may be positioned within a second work string). The drilling or servicing rig 106 may be conventional and may comprise a motor driven winch and other associated equipment for lowering the work string 112 into the wellbore 114. Alternatively, a mobile workover rig, a wellbore servicing unit (e.g., coiled tubing units), or the like may be used to lower the work string 112 into the wellbore 114. While FIG. 1 depicts a stationary drilling rig 106, one of ordinary skill in the art will readily appreciate that mobile workover rigs, wellbore servicing units (such as coiled tubing units), and the like may be employed.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In the embodiment of FIG. 1, at least a portion of the wellbore 114 is lined with a casing 120 that is secured into position against the formation 102 in a conventional manner using cement 122. In alternative operating environments, the wellbore 114 may be partially or fully uncased and/or uncemented. In an alternative embodiment, a portion of the wellbore may remain uncemented, but may employ one or more packers (e.g., Swellpackers™, commercially available from Halliburton Energy Services, Inc.) to isolate two or more adjacent portions or zones within the wellbore 114.

In the embodiment of FIG. 1, a wellbore servicing system 100 is illustrated comprising a first ASA cluster 100A and a second ASA cluster 100B incorporated within the work string 112 and positioned proximate and/or substantially adjacent to a first subterranean formation zone (or "pay zone") 102A and a second subterranean formation zone (or pay zone) 102B, respectively. Although the embodiment of FIG. 1 illustrates two ASA clusters, one of skill in the art viewing this disclosure will appreciate that any suitable number of ASA clusters may be similarly incorporated within a work string such as work string 112. Also, although the embodiment of FIG. 1 illustrates each ASA cluster 100A, 100B as comprising three ASAs (ASAs 200A and 200B, respectively), one of skill in the art viewing this disclosure will appreciate that an ASA cluster like ASA clusters 100A, 100B may suitably alternatively comprise two, four, five, six, seven, or more ASAs. In the embodiment of FIG. 1, the lower-most ASA within each ASA cluster 100A, 100B (e.g., the ASA located furthest downhole relative to the other ASAs of the same cluster) may be configured as a terminal ASA while the one or more other ASAs of the same ASA cluster 100A, 100B (e.g., the ASAs located uphole relative to the terminal ASA) may be configured as a nonterminal ASA.

In an embodiment, an ASA (cumulatively and non-specifically referred to as ASA 200 or, in an alternative embodiment, ASA 300) generally comprises a housing, a first sliding sleeve, a second sliding sleeve, and, a seat. In one of more of the embodiments disclosed herein, the ASAs may be transitionable from a "first" mode or configuration to a "second" mode or configuration and from the second mode or configuration to a "third" mode or configuration.

In one or more of the embodiments as will be disclosed herein, the housing may generally define an axial flowbore and may comprise one or more ports suitable for the communication of a fluid from the flowbore of the housing to and exterior of the housing.

Also, in one or more of the embodiments as will be disclosed herein, the first sliding sleeve may be movable relative to the housing from a first position to a second position. When the first sliding sleeve is in the first position, the first sliding sleeve may disallow a fluid pressure applied to the flowbore to cause the second sliding sleeve to move from the first position to the second position to and, when in the second position, the first sliding sleeve may allow a fluid pressure applied to the flowbore to cause the second sliding sleeve to move from the first position to the second position.

Also, in one or more of the embodiments as will be disclosed herein, the second sliding sleeve may be movable relative to the housing from a first position to a second position. When the second sliding sleeve is in the first position, the second sliding sleeve may obstruct fluid communication from the axial flowbore to an exterior of the housing via the one or more ports of the housing and, when in the second position, the second sliding sleeve may allow fluid communication from the axial flowbore to the exterior of the housing via the one or more ports of the housing.

Also, in one or more of the embodiments disclosed herein, where an ASA is configured as a non-terminal ASA, the seat may comprise an expandable seat; alternatively, where the ASA is configured as a terminal ASA, the seat may comprise a non-expandable seat, as will be disclosed herein.

In an embodiment, when the first sliding sleeve is in the first position and the second sliding sleeve is in the first position, the ASA is in the first mode, also referred to as a "locked-deactivated," "run-in," or "installation," mode or configuration. In the first mode, the ASA may be configured to not permit fluid communication between a flow bore generally defined by the ASA and the exterior of the ASA via the ports. The locked-deactivated mode may be referred to as such, for example, because the first sliding sleeve and the second sliding sleeve are selectively locked in position relative to the housing.

In an embodiment, when the first sliding sleeve is in the second position and the second sliding sleeve is in the first position, the ASA is in the second mode, also referred to as an "unlocked-deactivated," or "delay" mode or configuration. In the second mode, the ASA may be configured to not permit fluid communication between a flow bore generally defined by the ASA and the exterior of the ASA via the ports. Also, in the second mode, relative movement between the second sliding sleeve and the housing may be delayed insofar as (1) such relative movement occurs but occurs at a reduced and/or controlled rate, (2) such relative movement is delayed until the occurrence of a selected condition, or (3) combinations thereof.

In an embodiment, when the first sliding sleeve is in the second position and the second sliding sleeve is in the second position, the ASA is in the third mode, also referred to as an "activated" or "fully open mode." In the third mode, the ASA may be configured to allow fluid communication between a flow bore generally defined by the ASA and the exterior of the ASA via the ports.

At least two embodiments of an ASA are disclosed herein below. A first embodiment of such an ASA 200 is disclosed with respect to FIGS. 2A, 2B, and 2C and a second embodiment of such an ASA 300 is disclosed with respect to FIGS. 3A, 3B, and 3C.

Figure 2A:
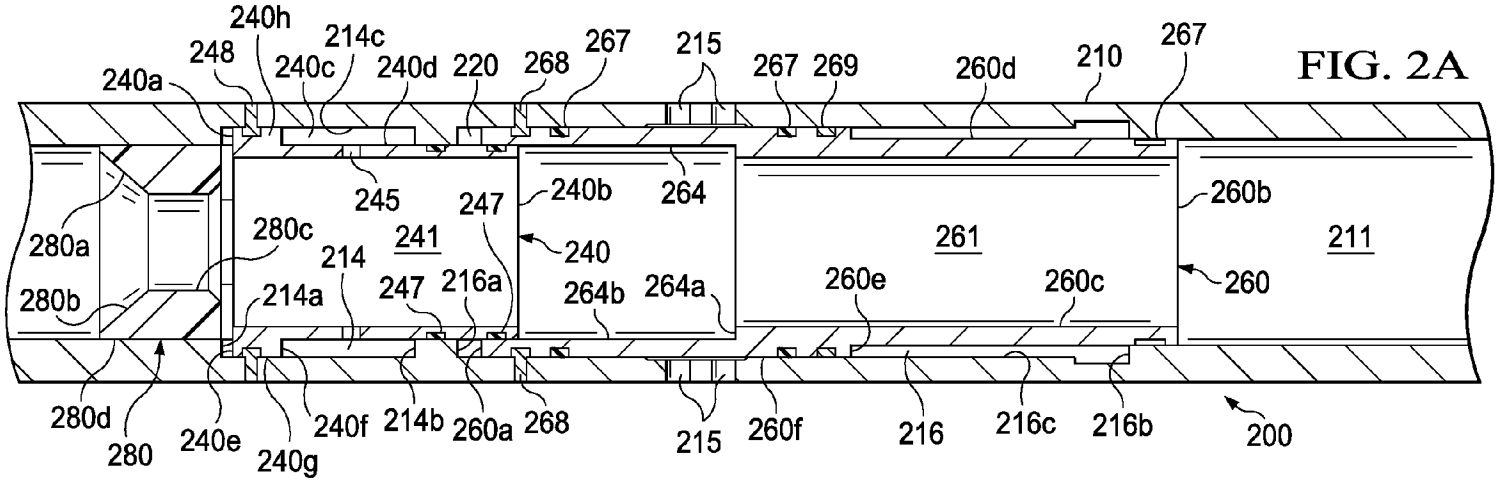
FIG. 2A is a cross-sectional view of a first embodiment of an ASA in an first mode.
Figure 2B:
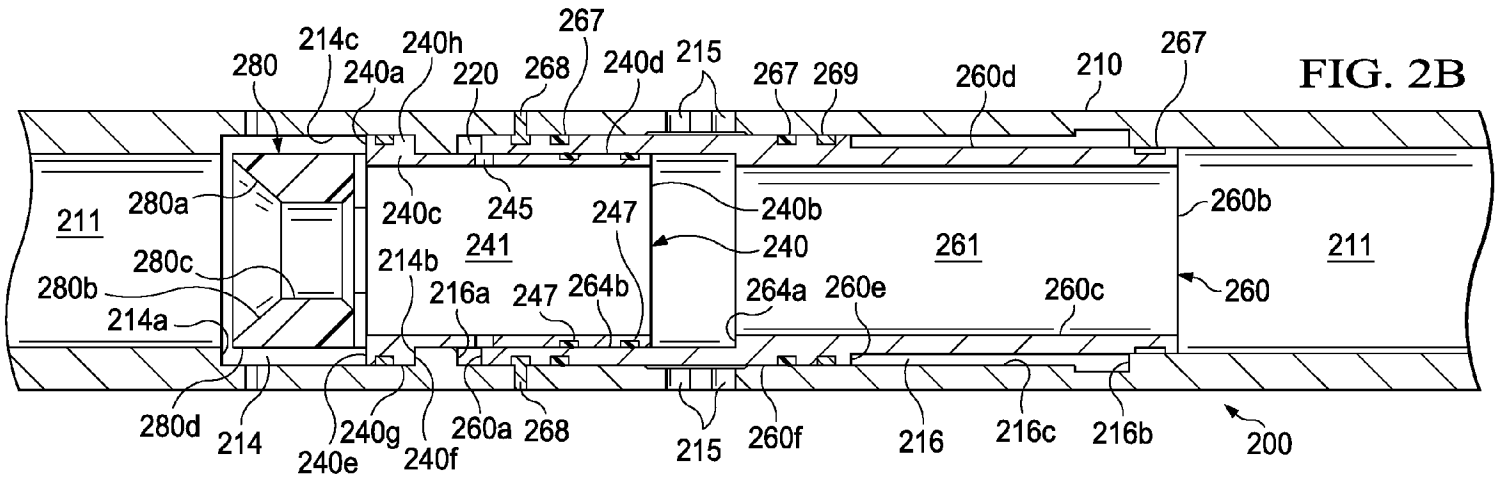
FIG. 2B is a cross-sectional view of a first embodiment of an ASA in an second mode.
Figure 2C:
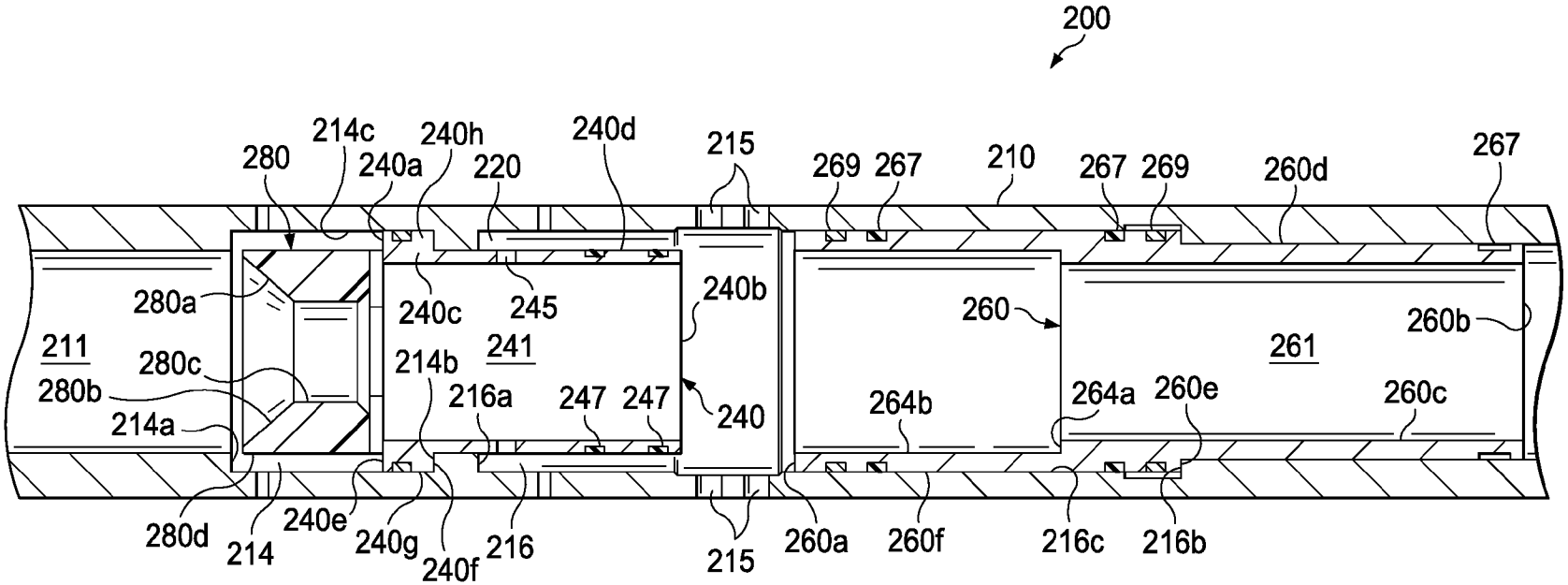
FIG. 2C is a cross-sectional view of a first embodiment of an ASA in an third mode.

Referring now to FIGS. 2A, 2B, and 2C an embodiment of an ASA 200 is illustrated in the locked-deactivated mode, the unlocked-deactivated mode, and the activated mode, respectively. In the embodiments of FIGS. 2A-2C, the ASA 200 generally comprises a housing 210, a first sliding sleeve 240, a second sliding sleeve 260, and a seat 280.

In an embodiment, the housing 210 may be characterized as a generally tubular body defining an axial flowbore 211 having a longitudinal axis. The axial flowbore 211 may be in fluid communication with the axial flowbore 113 defined by the work string 112. For example, a fluid communicated via the axial flowbore 113 of the work string 112 will flow into and the axial flowbore 211.

In an embodiment, the housing 210 may be configured for connection to and or incorporation within a work string such as work string 112. For example, the housing 210 may comprise a suitable means of connection to the work string 112 (e.g., to a work string member such as coiled tubing, jointed tubing, or combinations thereof). For example, in an embodiment, the terminal ends of the housing 210 comprise one or more internally or externally threaded surfaces, as may be suitably employed in making a threaded connection to the work string 112. Alternatively, an ASA may be incorporated within a work string by any suitable connection, such as, for example, via one or more quick-connector type connections. Suitable connections to a work string member will be known to those of skill in the art viewing this disclosure.

In an embodiment, the housing 210 may comprise a unitary structure; alternatively, the housing 210 may be comprise two or more operably connected components (e.g., two or more coupled sub-components, such as by a threaded connection). Alternatively, a housing like housing 210 may comprise any suitable structure, such suitable structures will be appreciated by those of skill in the art with the aid of this disclosure.

In an embodiment, the housing 210 may comprise one or more ports 215 suitable for the communication of fluid from the axial flowbore 211 of the housing 210 to a proximate subterranean formation zone when the ASA 200 is so-configured (e.g., when the ASA 200 is activated). For example, in the embodiment of FIGS. 2A and 2B, the ports 215 within the housing 210 are obstructed, as will be discussed herein, and will not communicate fluid from the axial flowbore 211 to the surrounding formation. In the embodiment of FIG. 2C, the ports 215 within the housing 210 are unobstructed, as will be discussed herein, and may communicate fluid from the axial flowbore 211 to the surrounding formation. In an embodiment, the ports 215 may be fitted with one or more pressure-altering devices (e.g., nozzles, erodible nozzles, or the like). In an additional embodiment, the ports 215 may be fitted with plugs, screens, covers, or shields, for example, to prevent debris from entering the ports 215.

In an embodiment, the housing 210 comprises a first sliding sleeve recess. For example, in the embodiment of FIGS. 2A, 2B, and 2C, the housing 210 comprises a first sliding sleeve recess 214. The first sliding sleeve recess 214 may generally comprise a passageway in which at least a portion of the first sliding sleeve 240 and may move longitudinally, axially, radially, or combinations thereof within the axial flowbore 211. In an embodiment, the first sliding sleeve recess 214 may comprise one or more grooves, guides, or the like, for example, to align and/or orient the first sliding sleeve 240. In the embodiment of FIGS. 2A, 2B, and 2C the first sliding sleeve recess 214 is generally defined by an upper shoulder 214*a*, a lower shoulder 214*b*, and the recessed bore surface 214*c* extending between the upper shoulder 214*a* and lower shoulder 214*b*.

In an embodiment, the housing 210 comprises a second sliding sleeve recess. For example, in the embodiment of FIGS. 2A, 2B, and 2C, the housing 210 comprises a second sliding sleeve recess 216. The second sliding sleeve recess 216 may generally comprise a passageway in which at least a portion of the second sliding sleeve 260 and may move longitudinally, axially, radially, or combinations thereof within the axial flowbore 211. In an embodiment, the second sliding sleeve recess 216 may comprise one or more grooves, guides, or the like, for example, to align and/or orient the second sliding sleeve 260. In the embodiment of FIGS. 2A, 2B, and 2C the second sliding sleeve recess 216 is generally defined by an upper shoulder 216*a*, a lower shoulder 216*b*, and the recessed bore surface 216*c* extending between the upper shoulder 216*a* and lower shoulder 216*b*.

In an embodiment, the first sliding sleeve 240 generally comprises a cylindrical or tubular structure. In an embodiment, the first sliding sleeve 240 generally comprises an upper orthogonal face 240*a*, a lower orthogonal face 240*b*, an inner cylindrical surface 240*c* at least partially defining an axial flowbore 241 extending therethrough, and an outer cylindrical surface 240*d*. In the embodiment of FIGS. 2A, 2B, and 2C, the first sliding sleeve 240 further comprises a raised portion 240*h* extending circumferentially about the first sliding sleeve 240 (e.g., forming a continuous or discontinuous ring or collar) and generally defined by an upper shoulder 240*e*, a lower shoulder 240*f*, and a raised outer cylindrical surface 240*g*.

In the embodiment of FIGS. 2A, 2B, and 2C the first sliding sleeve 240 may comprise a single component piece. In an alternative embodiment, a sliding sleeve like the first sliding sleeve 240 may comprise two or more operably connected or coupled component pieces (e.g., a collar welded about a tubular sleeve).

In an embodiment, the first sliding sleeve 240 may comprise an orifice suitable for the communication of a fluid. For example, in the embodiment of FIGS. 2A, 2B, and 2C, the first sliding sleeve 240 comprises orifice 245. In various embodiments, the orifice 245 may be sized and/or otherwise configured to communicate a fluid of a given character at a given rate. As may be appreciated by one of skill in the art, the rate at which a fluid is communicated via the orifice 245 may be at least partially dependent upon the viscosity of the fluid, the temperature of the fluid, the pressure of the fluid, the presence or absence of particulate material in the fluid, the flow-rate of the fluid, or combinations thereof.

In an embodiment, the orifice 245 may be formed by any suitable process or apparatus. For example, the orifice 245 may be cut into the first sliding sleeve with a laser, a bit, or any suitable apparatus in order to achieve a precise size and/or configuration. In an embodiment, an orifice like orifice 245 may be fitted with nozzles or erodible fittings, for example, such that the flow rate at which fluid is communicated via such an orifice varies over time. In an embodiment, an orifice like orifice 245 may be fitted with screens of a given size, for example, to restrict particulate flow through the orifice.

In an additional embodiment, an orifice like orifice 245 may be sized according to the position of the ASA of which it is a part in relation to one or more other similar orifices of other ASAs of the same ASA cluster. For example, in an ASA cluster comprising multiple ASAs, the furthest uphole of these ASA may comprise an orifice sized to allow a first flow-rate (e.g., the relatively slowest flow-rate), the second furthest uphole ASA may comprise an orifice sized to allow a second flow-rate (e.g., the second relatively slowest flow-rate), the third furthest uphole ASA may comprise an orifice sized to allow a third flow-rate (e.g., the third relatively slowest flow-rate), etc. For example, the first flow-rate may be less than the second flow-rate and the second flow-rate may be less than the third flow-rate.

In an embodiment, the second sliding sleeve 260 generally comprises a cylindrical or tubular structure. In an embodiment, the second sliding sleeve 260 generally comprises an upper orthogonal face 260*a*, a lower orthogonal face 260*b*, an inner cylindrical surface 260*c* at least partially defining an axial flowbore 261 extending therethrough, a lower shoulder 260*e*, an outer cylindrical surface 260*d* extending between the lower orthogonal face 260*b* and the lower shoulder 260*e*, and a raised outer cylindrical surface 260*f* extending between the upper orthogonal face 260*a* and the lower shoulder 260*e*. In an embodiment, the upper orthogonal face 260*a* may comprise a surface area greater than the surface area of the lower orthogonal face 260*b*.

In an embodiment, the second sliding sleeve 260 may comprise a first sliding sleeve recess. For example, in the embodiment of FIGS. 2A, 2B, and 2C, the second sliding sleeve 260 comprises a first sliding sleeve recess 264. The second sliding sleeve recess 264 may generally comprise a passageway in which at least a portion of the first sliding sleeve 240 may move into and be received, for example, longitudinally, axially, radially, or combinations thereof. In an embodiment, the first sliding sleeve recess 264 may comprise one or more grooves, guides, or the like, for example, to align and/or orient the first sliding sleeve 240. In the embodiment of FIGS. 2A, 2B, and 2C the first sliding sleeve recess 264 is generally defined by a shoulder 264*a* and a recessed bore surface 264*b* extending upward from shoulder 264*a* to the upper orthogonal face 260*a*.

In the embodiment of FIGS. 2A, 2B, and 2C the second sliding sleeve 260 may comprise a single component piece. In an alternative embodiment, a sliding sleeve like the second sliding sleeve 260 may comprise two or more operably connected or coupled component pieces (e.g., a larger tubular sleeve portion welded about a smaller tubular sleeve portion position concentric therein).

In an embodiment, the first sliding sleeve 240 may be slidably and concentrically positioned within the housing 210. In the embodiment of FIGS. 2A, 2B, and 2C at least a portion of the first sliding sleeve 240 may be positioned within the first sliding sleeve recess 214 of the housing 210. For example, at least a portion of the raised outer cylindrical surface 240*g* of the first sliding sleeve 240 may be slidably fitted against at least a portion of the recessed bore surface 214*c*. In an embodiment, the axial flowbore 241 defined by the first sliding sleeve 240 may be coaxial with and in fluid communication with the axial flowbore 211 defined by the housing 210.

In an embodiment, the first sliding sleeve 240, the first sliding sleeve recess 214, or both may comprise one or more seals at the interface between the raised outer cylindrical surface 240*g* of the first sliding sleeve 240 and the recessed bore surface 214*c*. For example, in an embodiment, the first sliding sleeve 240 further comprises one or more radial or concentric recesses or grooves configured to receive one or more suitable fluid seals, for example, to restrict fluid movement via the interface between the sliding sleeve 240 and the sliding sleeve recess 214. Suitable seals include but are not limited to a T-seal, an O-ring, a gasket, or combinations thereof.

Also, in an embodiment, the first sliding sleeve, 240 may be slidably and concentrically positioned within a portion of the second sliding sleeve 260, dependent upon the mode in which the ASA 200 is configured. For example at least a portion of the first sliding sleeve 240 may be telescopically positioned within a portion of the second sliding sleeve 260.In the embodiment of FIG. 2A and 2B, a portion of the first sliding sleeve 240 may be positioned within the first sliding sleeve recess 264 of the second sliding sleeve 260. For example, at least a portion of outer cylindrical surface 240*d* of the first sliding sleeve 240 may be slidably fitted against at least a portion of the recessed bore surface 264*b* of the second sliding sleeve 260.

In an embodiment, the first sliding sleeve 240, the first sliding sleeve recess 264, or both may comprise one or more seals at the interface between the outer cylindrical surface 240*d* of the first sliding sleeve 240 and the recessed bore surface 264*b*. For example, in the embodiment of FIGS. 2A, 2B, and 2C the first sliding sleeve 240 further comprises one or more radial or concentric recesses or grooves configured to receive one or more suitable fluid seals such as fluid seals 247, for example, to restrict fluid movement via the interface between the first sliding sleeve 240 and the first sliding sleeve recess 264. Suitable seals include but are not limited to a T-seal, an O-ring, a gasket, or combinations thereof.

In an embodiment, the second sliding sleeve 260 may be slidably and concentrically positioned within the housing 210. In the embodiment of FIGS. 2A, 2B, and 2C the second sliding sleeve 260 may be positioned within the second sliding sleeve recess 216. For example, at least a portion of the raised outer cylindrical surface 260*f* of the second sliding sleeve 260 may be slidably fitted against at least a portion of the recessed bore surface 216*c*. In an embodiment, the axial flowbore 261 defined by the second sliding sleeve 260 may be coaxial with and in fluid communication with the axial flowbore 211 defined by the housing 210.

In an embodiment, the second sliding sleeve 260, the second sliding sleeve recess 216, or both may comprise one or more seals at the interface between the outer cylindrical surface 260*d* of the first sliding sleeve 260 and the recessed bore surface 216*c*. For example, in the embodiment of FIGS. 2A, 2B, and 2C the second sliding sleeve 260 further comprises one or more radial or concentric recesses or grooves configured to receive one or more suitable fluid seals such as fluid seals 267, for example, to restrict fluid movement via the interface between the sliding sleeve 260 and the second sliding sleeve recess 216. Suitable seals include but are not limited to a T-seal, an O-ring, a gasket, or combinations thereof.

In the embodiment of FIGS. 2A, 2B, and 2C, the first sliding sleeve 240 may be positioned above (e.g., uphole relative to) the second sliding sleeve 260. In an alternative embodiment, as will be described herein, a first sliding sleeve like first sliding sleeve 240 may be positioned below a second sliding sleeve like second sliding sleeve 260.

In an embodiment, the housing 210, the first sliding sleeve 240, and the second sliding sleeve may cooperatively define a fluid reservoir 220, dependent upon the mode in which the ASA 200 is configured. For example, referring to FIGS. 2A and 2B, the fluid reservoir 220 is substantially defined by the recessed bore surface 216*c* of the second sliding sleeve recess 216, the upper shoulder 216*a* of the second sliding sleeve recess 216, the outer cylindrical surface 240*d* of the first sliding sleeve 240, and the upper orthogonal face 260*a* of the second sliding sleeve 260.

In an embodiment, the fluid chamber 220 may be of any suitable size, as will be appreciated by one of skill in the art viewing this disclosure. For example, in an embodiment, a fluid chamber like fluid chamber 220 may be sized according to the position of the ASA of which it is a part in relation to one or more other similar orifices of other ASAs of the same ASA cluster. For example, in an ASA cluster comprising multiple ASAs, the furthest uphole of these ASA may comprise an fluid chamber of a first volume (e.g., the relatively largest volume), the second furthest uphole ASA may comprise a fluid chamber of a second volume (e.g., the second relatively largest volume), the third furthest uphole ASA may comprise a fluid chamber of a third volume (e.g., the third relatively largest volume), etc. For example, the first volume may be greater than the second volume and the second volume may be greater than the third volume.

In an embodiment, the first sliding sleeve 240 may be slidably movable between a first position and a second position with respect to the housing 210. Referring again to FIG. 2A, the first sliding sleeve 240 is shown in the first position. In the first position, the upper shoulder 240*e* of the raised portion of the first sliding sleeve 240 may abut and/or be located substantially adjacent to the upper shoulder 214*a* of the first sliding sleeve recess 214. When the first sliding sleeve 240 is in the first position, the first sliding sleeve 240 may be characterized as in its upper-most position relative to the housing 210. Referring again to FIGS. 2B and 2C, the first sliding sleeve 240 is shown in the second position. In the second position, the lower shoulder 240*f* of the raised portion of the first sliding sleeve 240 may abut and/or be located substantially adjacent to the lower shoulder 214*b* of the first sliding sleeve recess 214. When the first sliding sleeve 240 is in the second position, the first sliding sleeve 240 may be characterized as in its lower-most position relative to the housing 210.

In the embodiment of FIG. 2A where the first sliding sleeve 240 is in the first position, the first sliding sleeve 240 may be configured and/or positioned to disallow fluid communication from the axial flowbore 211 and/or axial flowbore 241 to the fluid reservoir 220 via orifice 245 (e.g., orifice 245 does not provide a route of fluid communication to the fluid reservoir 220). In the embodiment of FIG. 2B where the first sliding sleeve 240 is in the second position, the first sliding sleeve 240 may be configured to allow fluid communication from the axial flowbore 211 and/or axial flowbore 241 to the fluid reservoir 220 via the orifice 245 (e.g., orifice 245 provides a route of fluid communication to the fluid chamber 220). In an embodiment, when the first sliding sleeve 240 is in the first position, the second sliding sleeve may be retained in the first position. Particularly, because the orifice 245 does not provide a route of fluid communication to the fluid chamber 220, fluid will not be communicated to the fluid chamber 220 and, as such, fluid pressure will not be exerted against the second sliding sleeve 260 to move the second sliding sleeve 260, as will be discussed below.

In an embodiment, the first sliding sleeve 240 may be held in the first position and/or the second position by suitable retaining mechanism. For example, in the embodiment of FIG. 2A, the first sliding sleeve 240 is retained in the first position by one or more shear-pins 248 or the like. The shear pins may be received by shear-pin bore within the first sliding sleeve 240 and shear-pin bore in the tubular body 210.

In an embodiment, the second sliding sleeve 260 may be slidably movable between a first position and a second position with respect to the housing 210. Referring again to FIGS. 2A and 2B, the second sliding sleeve 260 is shown in the first position. In the first position, the upper orthogonal face 260*a* of the second sliding sleeve 260 may be adjacent and/or substantially proximate to the upper shoulder 216*a* of the second sliding sleeve recess 216. When the second sliding sleeve 260 is in the first position, the second sliding sleeve 260 may be characterized as in its upper-most position relative to the housing 210. Referring again to FIG. 2C, the second sliding sleeve 260 is shown in the second position. In the second position, the lower shoulder 260*e* of the second sliding sleeve 260 may abut the lower shoulder 216*b* of the second sliding sleeve recess 216. When the second sliding sleeve 260 is in the second position, the second sliding sleeve 260 may be characterized as in its lower-most position relative to the housing 210.

In an embodiment, the second sliding sleeve 260 may be configured to allow or disallow fluid communication between the axial flowbore 211 of the housing and the exterior of the housing 210, dependent upon the position of the second sliding sleeve relative to the housing 210. For example, in the embodiment of FIGS. 2A and 2B, when the second sliding sleeve 260 is in the first position, the second sliding sleeve 260 obstructs the ports 215 of the housing 210 and, thereby, restricts fluid communication via the ports 215. In the embodiment of FIG. 2C, when the second sliding sleeve 260 is in the second position, the second sliding sleeve 260 does not obstruct the ports 215 of the housing and, thereby allows fluid communication via the ports 215.

In an alternative embodiment, a second sliding sleeve like second sliding sleeve 260 comprises one or more ports suitable for the communication of fluid from the axial flowbore 211 of the housing 210 to an exterior of the housing when so-configured. For example, in such an embodiment, where the second sliding sleeve is in the first position, the ports within the second sliding sleeve are misaligned with the ports 215 of the housing and will not communicate fluid from the axial flowbore 211 to the exterior of the housing. Also, in such an embodiment, where the second sliding sleeve is in the second position, the ports within the second sliding sleeve are aligned with the ports 215 of the housing and will communicate fluid from the axial flowbore 211 to the exterior of the housing 210.

In an embodiment, the second sliding sleeve 260 may be retained in the first position and/or the second position by suitable retaining mechanism. For example, in the embodiment of FIGS. 2A and 2B, the second sliding sleeve 260 is retained in the first position by one or more shear-pins 268 or the like. The shear pins may be received by shear-pin bore within the second sliding sleeve 260 and shear-pin bore in the tubular body 210.

Also, in the embodiment of FIG. 2C the second sliding sleeve 260 may be retained in the second position by a snap-ring 269, alternatively, by a C-ring, a biased pin, ratchet teeth, or combinations thereof. The snap-ring 269 may be carried in a suitable slot, groove, channel, bore, or recess in the second sliding sleeve 260, alternatively, in the housing 210, and may expand into and be received by a suitable slot groove, channel, bore, or recess in the housing 210, or, alternatively, in the second sliding sleeve 260.

In an embodiment where the ASA 200 is configured as a non-terminal ASA, the seat 280 may comprise an expandable seat. In an embodiment, such a seat 280 may be configured to receive, engage, and retain an obturating member (e.g., a ball or dart) of a given size and/or configuration moving via axial flowbore 211 when the seat 280 is in a narrower, non-expanded conformation and to release the obturating member when the seat 280 is in a larger, expanded conformation. In the embodiment of FIG. 2A, the expandable seat 280 is illustrated in such a narrow conformation and, in the embodiment of FIGS. 2B and 2C, the seat 280 is illustrated in an expanded conformation.

In the embodiment of FIGS. 2A, 2B, and 2C, the expandable seat 280 generally comprises an inner bore surface 280*c* generally defining a flowbore having a reduced diameter relative to the diameter of axial flowbores 211, 241 and, 261, a bevel or chamfer 280*a* at the reduction in flowbore diameter, a lower orthogonal face 280*b*, and an outer cylindrical surface 280*d*.

Figure 4A:
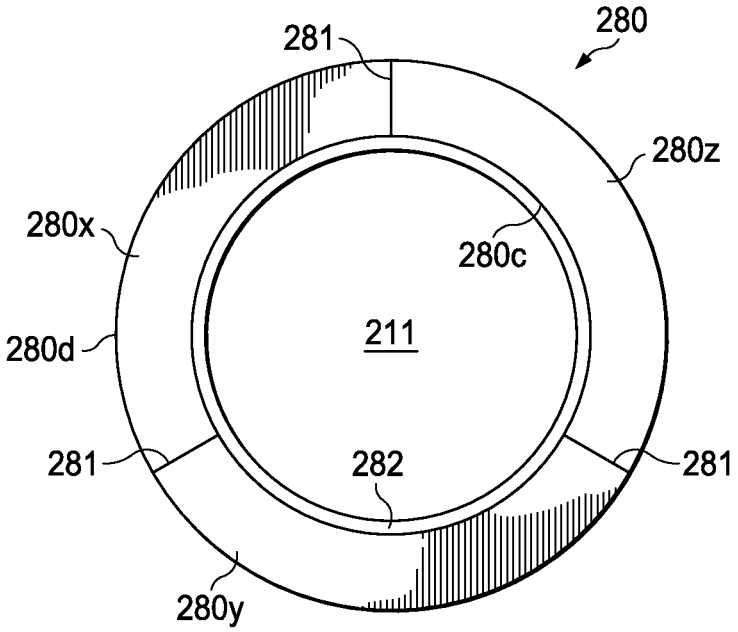
FIG. 4A is an end view of an embodiment of an expandable, segmented seat having a protective sheath covering at least some of the surfaces thereof.

In an embodiment, the expandable seat 280 comprises a segmented seat. In an embodiment, such a segmented seat may be radially divided with respect to central axis into a plurality of segments. For example, referring now to FIG. 4A, an expandable, segmented seat 280 is illustrated as divided (e.g., as represented by dividing or segmenting lines/cuts 281) into three complementary segments of approximately equal size, shape, and/or configuration. In the embodiment of FIG. 4A, the three complementary segments (280X, 280Y, and 280Z, respectively) together form the expandable, segmented seat 280, with each of the segments (280X, 280Y, and 280Z) constituting about one-third (e.g., extending radially about 120°) of the expandable, segmented seat 280. In an alternative embodiment, a segmented seat like expandable, segmented seat 280 may comprise any suitable number of equally or unequally-divided segments. For example, a segmented seat may comprise two, four, five, six, or more complementary, radial segments. The expandable, segmented seat 280 may be formed from a suitable material. Nonlimiting examples of such a suitable material include composites, phenolics, cast iron, aluminum, brass, various metal alloys, rubbers, ceramics, or combinations thereof. In an embodiment, the material employed to form the segmented seat may be characterized as drillable, that is, the expandable, segmented seat 280 may be fully or partially degraded or removed by drilling, cutting, milling, etc., as will be appreciated by one of skill in the art with the aid of this disclosure. Segments 280X, 280Y, and 280Z may be formed independently or, alternatively, a preformed seat may be divided into segments.

In an alternative embodiment, an expandable seat may be constructed from a generally serpentine length of a suitable material and may comprise a plurality of serpentine loops between upper and lower portions of the seat and continuing circumferentially to form the seat. Such an expandable seat is generally configured to be biased radially outward so that if unrestricted radially, the outer and/or inner diameter of the seat will increase. In some embodiments, examples of a suitable material may include but are not limited to, a low-alloy steel such as AISI 4140 or 4130.

An alternative embodiment, an expandable seat like expandable seat 280 may be configured in a collet arrangement generally comprising a plurality of collet fingers. The collet fingers of such an expandable seat is generally configured to be biased radially outward so that if unrestricted radially, the outer and/or inner diameter of the seat will increase.

Figure 4B:
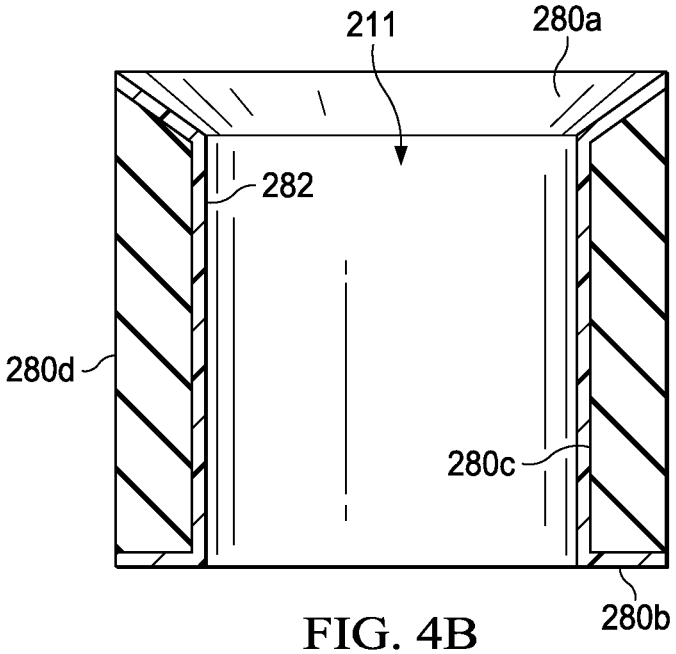
FIG. 4B is a cross-section view of an embodiment of an expandable, segmented seat having a protective sheath covering at least some of the surfaces thereof.

In the embodiment of FIGS. 2A, 2B, and 2C, one or more surfaces of the expandable seat 280 may be covered by a protective sheath 282. Referring to FIGS. 4A and 4B, an embodiment of the expandable, segmented seat 280 and protective sheath 282 are illustrated in greater detail. In the embodiment of FIGS. 4A and 4B the protective sheath 282 covers the exterior surfaces of the chamfer 280*a* of the expandable, segmented seat 280, the inner bore 280*c* of the expandable, segmented seat 280, and a lower face 280*b* of the expandable, segmented seat 280. In an alternative embodiment, a protective sheath may cover the chamfer 280*a*, the inner bore 280*c*, the lower orthogonal face 280*b*, the outer cylinder surface 280*d*, or combinations thereof. In another alternative embodiment, a protective sheath may cover any one or more of the surfaces of a segmented seat 280, as will be appreciated by one of skill in the art viewing this disclosure. In the embodiment illustrated by FIGS. 4A and 4B, the protective sheath 282 forms a continuous layer over those surfaces of the expandable, segmented seat 280 in fluid communication with the flowbore 211. For example, small crevices or gaps (e.g., at dividing lines 281) may exist at the radially extending divisions between the segments (e.g., 280×, 280Y, and 280Z) of the expandable seat 280. In an embodiment, the continuous layer formed by the protective sheath 282 may fill, seal, minimize, or cover, any such crevices or gaps such that a fluid flowing via the flowbore 211 (and/or particulate material therein) will be impeded from contacting and/or penetrating any such crevices or gaps.

In an embodiment, the protective sheath 282 may be formed from a suitable material. Nonlimiting examples of such a suitable material include ceramics, carbides, hardened plastics, molded rubbers, various heat-shrinkable materials, or combinations thereof. In an embodiment, the protective sheath may be characterized as having a hardness of from about 25 durometers to about 150 durometers, alternatively, from about 50 durometers to about 100 durometers, alternatively, from about 60 durometers to about 80 durometers. In an embodiment, the protective sheath may be characterized as having a thickness of from about $1/64^{th}$ of an inch to about $3/16^{th}$ of an inch, alternatively, about $1/32^{nd}$ of an inch. Examples of materials suitable for the formation of the protective sheath include nitrile rubber, which commercially available from several rubber, plastic, and/or composite materials companies.

In an embodiment, a protective sheath, like protective sheath 282, may be employed to advantageously lessen the degree of erosion and/or degradation to a segmented seat, like expandable seat 280. Not intending to be bound by theory, such a protective sheath may improve the service life of a segmented seat covered by such a protective sheath by decreasing the impingement of erosive fluids (e.g., cutting, hydrojetting, and/or fracturing fluids comprising abrasives and/or proppants) with the segmented seat. In an embodiment, a segmented seat protected by such a protective sheath may have a service life at least 20% greater, alternatively, at least 30% greater, alternatively, at least 35% greater than an otherwise similar seat not protected by such a protective sheath.

In an embodiment, the expandable seat 280 may further comprise a seat gasket that serves to seal against an obturator. In some embodiments, the seat gasket may be constructed of rubber. In such an embodiment and installation mode, the seat gasket may be substantially captured between the expandable seat and the lower end of the sleeve. In an embodiment, the protective sheath 282 may serve as such a gasket, for example, by engaging and/or sealing an obturator. In such an embodiment, the protective sheath 282 may have a variable thickness (e.g., a thicker portion, such as the portion covering the chamfer 280*a*). For example, the surface(s) of the protective sheath 282 configured to engage the obturator may comprise a greater thickness than the one or more other surfaces of the protective sheath 282.

In an embodiment where the ASA 200 is configured as a terminal ASA, the seat 280 may comprise a non-expandable seat. Alternatively, as will be disclosed below, in embodiment where the ASA 200 is configured as a terminal ASA, the seat 280 may comprise an expandable seat as described herein above that is not allowed to expand into the expanded conformation. In an embodiment, such a non-expandable seat 280 may be configured to receive, engage, and retain an obturating member (e.g., a ball or dart). In the embodiment of FIGS. 2A, 2B, and 2C, the non-expandable seat 280 generally comprises an inner bore surface 280*c* generally defining a flowbore having a reduced diameter relative to the diameter of axial flowbores 211, 241 and, 261, a bevel or chamfer 280*a* at the reduction in flowbore diameter, a lower orthogonal face 280*b*, and an outer cylindrical surface 280*d*.

In the embodiment of FIGS. 2A, 2B, and 2C, the seat 280 comprises a separate component from the first sliding sleeve 240. In an alternative embodiment, the seat 280 may be integrated within and/or coupled to the first sliding sleeve 240.

In an embodiment, the seat 280 may be slidably positioned within the housing 210. In the embodiment of FIGS. 2A, 2B, and 2C, the seat 280 is positioned uphole relative to the first sliding sleeve 240. In an embodiment, the seat 280 may be slidably movable between a first position and a second position with respect to the housing 210. Referring again to FIG. 2A, the seat 280 is shown in the first position. In the first position, the seat 280 may be contained within the housing 210 above the first sliding sleeve recess 214 and, referring to FIGS. 2B and 2C, the expandable seat 280 is shown in the second position.

In an embodiment where the ASA 200 is configured as a non-terminal ASA and, therefore, comprises an expandable seat 280, when the seat 280 is in the first position, seat 280 may be retained in the narrower, non-expanded conformation and, when the expandable seat 280 is in the second position, the expandable seat 280 may be allowed to expand into the larger, expanded conformation. For example, in the embodiment of FIG. 2A where the seat 280 is in the first position, the seat 280 is within a relatively narrower portion of the housing 210, and is therefore retained in the narrower, non-expanded conformation. In the embodiment of FIGS. 2B and 2C, where the seat 280 is in the second position, the seat 280 is in a relatively wider portion of the housing 210 (e.g., having a larger inside diameter), for example, the first sliding sleeve recess 214, and is therefore allowed to expand into the expanded conformation. In the embodiment of FIG. 2A where the seat 280 is in the first position, the seat 280 may be configured and/or positioned to engage and retain an obturating member (e.g., a ball or dart) moving via the axial flowbore 211, thereby creating a barrier to fluid communication via the axial flowbore 211. In the embodiment of FIGS. 2B and 2C where the expandable seat 280 has shifted downhole and is in the second position, the expandable seat 280 may be configured to release such an obturating member, thereby allowing the obturating member to move downward through the axial flowbore 211.

In embodiment where the ASA 200 is configured as a terminal ASA, when the seat 280 is the first position, the seat 280 may be retained in the narrower, non-expanded confirmation in both the first position and the second position. As such, the seat 280 may be configured and/or positioned to engage and retain an obturating member (e.g., a ball or dart) moving via the axial flowbore 211, thereby creating a barrier to fluid communication via the axial flowbore 211 and will not expand to release an obturating member that has engaged the seat 280.

Figure 3A:
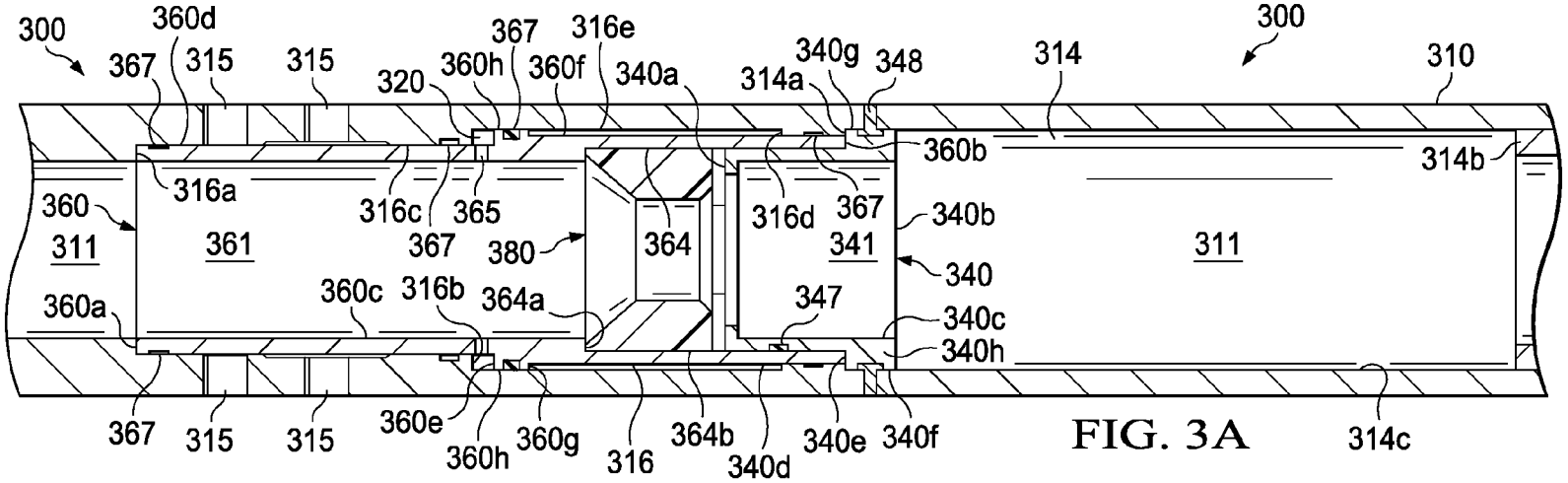
FIG. 3A is a cross-sectional view of a second embodiment of an ASA in an first mode.
Figure 3B:
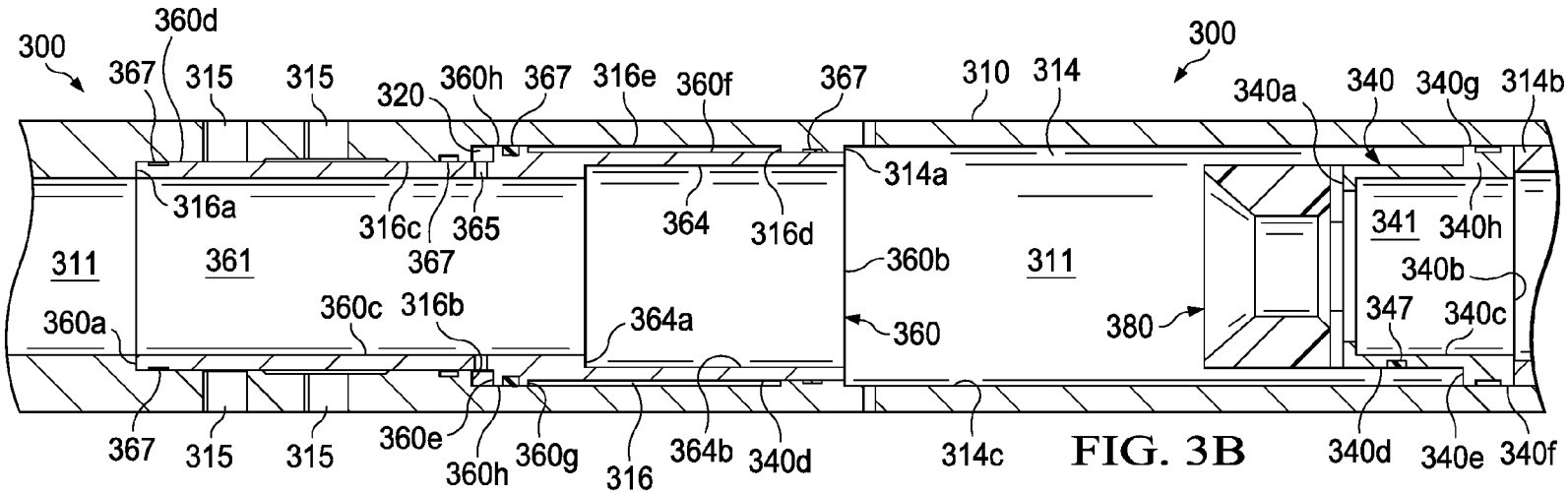
FIG. 3B is a cross-sectional view of a second embodiment of an ASA in an second mode.
Figure 3C:
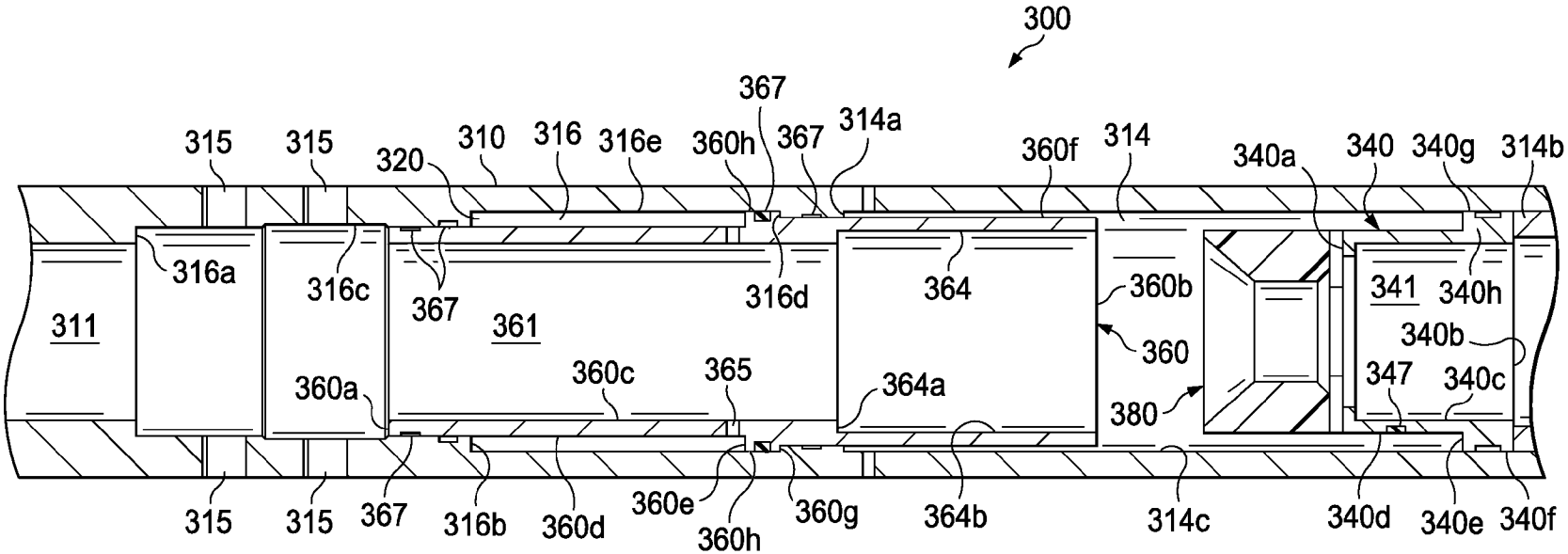
FIG. 3C is a cross-sectional view of a second embodiment of an ASA in an third mode.

Referring now to FIGS. 3A, 3B, and 3C an alternative embodiment of an ASA 300 is illustrated in the locked-deactivated mode, the unlocked-deactivated mode, and the activated mode, respectively. In the embodiments of FIGS. 3A-3C, the ASA 300 generally comprises a housing 310, a first sliding sleeve 340, a second sliding sleeve 360, and a seat 380.

In an embodiment, the housing 310 may be characterized as a generally tubular body defining an axial flowbore 311 having a longitudinal axis. The axial flowbore 311 may be in fluid communication with the axial flowbore 113 defined by the work string 112. For example, a fluid communicated via the axial flowbore 113 of the work string 112 will flow into and the axial flowbore 311.

In an embodiment, the housing 310 may be configured for connection to and or incorporation within a work string such as work string 112. For example, the housing 310 may comprise a suitable means of connection to the work string 112 (e.g., to a work string member such as coiled tubing, jointed tubing, or combinations thereof). For example, in an embodiment, the terminal ends of the housing 310 comprise one or more internally or externally threaded surfaces, as may be suitably employed in making a threaded connection to the work string 112. Alternatively, an ASA may be incorporated within a work string by any suitable connection, such as, for example, via one or more quick-connector type connections. Suitable connections to a work string member will be known to those of skill in the art viewing this disclosure.

In an embodiment, the housing 310 may comprise a unitary structure; alternatively, the housing 310 may be comprise two or more operably connected components (e.g., two or more coupled sub-components, such as by a threaded connection). Alternatively, a housing like housing 310 may comprise any suitable structure, such suitable structures will be appreciated by those of skill in the art with the aid of this disclosure.

In an embodiment, the housing 310 may comprise one or more ports 315 suitable for the communication of fluid from the axial flowbore 311 of the housing 310 to a proximate subterranean formation zone when the ASA 300 is so-configured (e.g., when the ASA 300 is activated). For example, in the embodiment of FIGS. 3A and 3B, the ports 315 within the housing 310 are obstructed, as will be discussed herein, and will not communicate fluid from the axial flowbore 311 to the surrounding formation. In the embodiment of FIG. 3C, the ports 315 within the housing 310 are unobstructed, as will be discussed herein, and may communicate fluid from the axial flowbore 311 to the surrounding formation. In an embodiment, the ports 315 may be fitted with one or more pressure-altering devices (e.g., nozzles, erodible nozzles, or the like). In an additional embodiment, the ports 315 may be fitted with plugs, screens, covers, or shields, for example, to prevent debris from entering the ports 315.

In an embodiment, the housing 310 comprises a first sliding sleeve recess. For example, in the embodiment of FIGS. 3A, 3B and 3C, the housing 310 comprises a first sliding sleeve recess 314. The first sliding sleeve recess 314 may generally comprise a passageway in which at least a portion of the first sliding sleeve 340 and may move longitudinally, axially, radially, or combinations thereof within the axial flowbore 311. In an embodiment, the first sliding sleeve recess 314 may comprise one or more grooves, guides, or the like, for example, to align and/or orient the first sliding sleeve 340. In the embodiment of FIGS. 3A, 3B, and 3C the first sliding sleeve recess 314 is generally defined by an upper shoulder 314*a*, a lower shoulder 314*b*, and the recessed bore surface 314*c* extending between the upper shoulder 314*a* and lower shoulder 314*b*.

In an embodiment, the housing 310 comprises a second sliding sleeve recess. For example, in the embodiment of FIGS. 3A, 3B and 3C, the housing 310 comprises a second sliding sleeve recess 316. The second sliding sleeve recess 316 may generally comprise a passageway in which at least a portion of the second sliding sleeve 360 and may move longitudinally, axially, radially, or combinations thereof within the axial flowbore 311. In an embodiment, the second sliding sleeve recess 316 may comprise one or more grooves, guides, or the like, for example, to align and/or orient the second sliding sleeve 360. In the embodiment of FIGS. 3A, 3B, and 3C the second sliding sleeve recess 316 is generally defined by an upper shoulder 316*a*, an intermediate shoulder 316*b*, a lower shoulder 316*d*, a first recessed bore surface 316*c* extending between the upper shoulder 316*a* and intermediate shoulder 316*b*, and a second recessed bore surface 316*e* extending between the intermediate shoulder 316*b* and the lower shoulder 316*d*.

In an embodiment, the first sliding sleeve 340 generally comprises a cylindrical or tubular structure. In an embodiment, the first sliding sleeve 340 generally comprises an upper orthogonal face 340*a*, a lower orthogonal face 340*b*, an inner cylindrical surface 340*c* at least partially defining an axial flowbore 341 extending therethrough, and an outer cylindrical surface 340*d*. In the embodiment of FIGS. 3A, 3B, and 3C, the first sliding sleeve 340 further comprises raised portion 340*h* extending circumferentially about the first sliding sleeve 340 (e.g., forming a continuous or discontinuous ring or collar) and generally defined by an upper shoulder 340*e*, the lower orthogonal face 340*b*, and a raised outer cylindrical surface 340*g*.

In the embodiment of FIGS. 3A, 3B, and 3C the first sliding sleeve 340 may comprise a single component piece. In an alternative embodiment, a sliding sleeve like the first sliding sleeve 340 may comprise two or more operably connected or coupled component pieces (e.g., a collar welded about a tubular sleeve).

In an embodiment, the second sliding sleeve 360 generally comprises a cylindrical or tubular structure. In an embodiment, the second sliding sleeve 360 generally comprises an upper orthogonal face 360*a*, a lower orthogonal face 360*b*, an inner cylindrical surface 360*c* at least partially defining an axial flowbore 361 extending therethrough, an upper shoulder 360*e*, a first outer cylindrical surface 360*d* extending between the upper orthogonal face 360*a* and an upper shoulder 360*e*, a second outer cylindrical surface 360*f* extending between the lower orthogonal face 360*b* and the a lower shoulder 360*g*, and a raised outer cylindrical surface 360*h* extending between the upper shoulder 360*e* and the lower shoulder 360*g*. In an embodiment, the upper orthogonal face 360*a* and the upper shoulder 360*e* may comprise a surface area greater than the surface area of the lower orthogonal face 360*b*.

In an embodiment, the second sliding sleeve 360 may comprise a first sliding sleeve recess. For example, in the embodiment of FIGS. 3A, 3B and 3C, the second sliding sleeve 360 comprises a first sliding sleeve recess 364. The first sliding sleeve recess 364 may generally comprise a passageway in which at least a portion of the first sliding sleeve 340 may move into and be received, for example, longitudinally, axially, radially, or combinations thereof. In an embodiment, the first sliding sleeve recess 364 may comprise one or more grooves, guides, or the like, for example, to align and/or orient the first sliding sleeve 340. In the embodiment of FIGS. 3A, 3B, and 3C the first sliding sleeve recess 364 is generally defined by a shoulder 364*a* and a recessed bore surface 364*b* extending downward from shoulder 364*a* to the lower orthogonal face 360*b*.

In the embodiment of FIGS. 3A, 3B, and 3C the second sliding sleeve 360 may comprise a single component piece. In an alternative embodiment, a sliding sleeve like the first sliding sleeve 340 may comprise two or more operably connected or coupled component pieces (e.g., a larger tubular sleeve portion welded about a smaller tubular sleeve portion position concentric therein).

In an embodiment, the second sliding sleeve 360 may comprise an orifice suitable for the communication of a fluid. For example, in the embodiment of FIGS. 3A, 3B, and 3C, the second sliding sleeve 360 comprises orifice 365. In various embodiments, the orifice 365 may be sized and/or otherwise configured to communicate a fluid of a given character at a given rate. As may be appreciated by one of skill in the art, the rate at which a fluid is communicated via the orifice 365 may be at least partially dependent upon the viscosity of the fluid, the temperature of the fluid, the pressure of the fluid, the presence or absence of particulate material in the fluid, the flow-rate of the fluid, or combinations thereof. In an embodiment, the orifice 365 may be formed by any suitable process or apparatus. For example, the orifice 365 may be cut into the second sliding sleeve with a laser, a bit, or any suitable apparatus in order to achieve a precise size and/or configuration.

In an embodiment, an orifice like orifice 365 may be fitted with nozzles or erodible fittings, for example, such that the flow rate at which fluid is communicated via such an orifice varies over time. In an embodiment, an orifice like orifice 365 may be fitted with screens of a given size, for example, to restrict particulate flow through the orifice.

In an additional embodiment, an orifice like orifice 365 may be sized according to the position of the ASA of which it is a part in relation to one or more other similar orifices of other ASAs of the same ASA cluster. For example, in an ASA cluster comprising multiple ASAs, the furthest uphole of these ASA may comprise an orifice sized to allow a first flow-rate (e.g., the relatively slowest flow-rate), the second furthest uphole ASA may comprise an orifice sized to allow a second flow-rate (e.g., the second relatively slowest flow-rate), the third furthest uphole ASA may comprise an orifice sized to allow a third flow-rate (e.g., the third relatively slowest flow-rate), etc. For example, the first flow-rate may be less than the second flow-rate and the second flow-rate may be less than the third flow-rate.

In an embodiment, the first sliding sleeve 340 may be slidably and concentrically positioned within the housing 310. In the embodiment of FIGS. 3A, 3B, and 3C at least a portion of the first sliding sleeve 340 may be positioned within the first sliding sleeve recess 314 of the housing 310. For example, at least a portion of the raised outer cylindrical surface 340*f* of the first sliding sleeve 340 may be slidably fitted against at least a portion of the recessed bore surface 314*c*. In an embodiment, the axial flowbore 341 defined by the first sliding sleeve 340 may be coaxial with and in fluid communication with the axial flowbore 311 defined by the housing 310.

In an embodiment, the first sliding sleeve 340, the first sliding sleeve recess 314, or both may comprise one or more seals at the interface between the raised outer cylindrical surface 340*f* of the first sliding sleeve 340 and the recessed bore surface 314*c*. For example, in an embodiment, the first sliding sleeve 340 further comprises one or more radial or concentric recesses or grooves configured to receive one or more suitable fluid seals such as fluid seals, for example, to restrict fluid movement via the interface between the sliding sleeve 340 and the sliding sleeve recess 314. Suitable seals include but are not limited to a T-seal, an O-ring, a gasket, or combinations thereof.

Also, in an embodiment, the first sliding sleeve 340 may be slidably and concentrically positioned within a portion of the second sliding sleeve 360, dependent upon the mode in which the ASA 300 is configured. For exampled, at least a portion of the first sliding 340, sleeve 340 may be telescopically positioned within a portion of the second sliding sleeve 360.In the embodiment of FIG. 3A, a portion of the first sliding sleeve 340 may be positioned within the first sliding sleeve recess 364 of the second sliding sleeve 360. For example, at least a portion of the outer cylindrical surface 340d of the first sliding sleeve 340 may be slidably fitted against at least a portion of the recessed bore surface 364b of the second sliding sleeve 360.

In an embodiment, the first sliding sleeve 340, the first sliding sleeve recess 364, or both may comprise one or more seals at the interface between the outer cylindrical surface 340*d* of the first sliding sleeve 340 and the recessed bore surface 364*b*. For example, in the embodiment of FIGS. 3A, 3B, and 3C the first sliding sleeve 340 further comprises one or more radial or concentric recesses or grooves configured to receive one or more suitable fluid seals such as fluid seals 347, for example, to restrict fluid movement via the interface between the sliding sleeve 340 and the first sliding sleeve recess 364. Suitable seals include but are not limited to a T-seal, an O-ring, a gasket, or combinations thereof.

In an embodiment, the second sliding sleeve 360 may be slidably and concentrically positioned within the housing 310. In the embodiment of FIGS. 3A, 3B, and 3C the second sliding sleeve 360 may be positioned within the second sliding sleeve recess 316. For example, at least a portion of the first outer cylindrical surface 360*d* of the second sliding sleeve 360 may be slidably fitted against at least a portion of the first recessed bore surface 316*c* and at least a portion of the raised outer cylindrical surface 360*h* may be slidably fitted against the second recessed bore surface 316*e*. In an embodiment, the axial flowbore 361 defined by the second sliding sleeve 360 may be coaxial with and in fluid communication with the axial flowbore 311 defined by the housing 310.

In an embodiment, the second sliding sleeve 360, the second sliding sleeve recess 316, or both may comprise one or more seals at the interface between the first outer cylindrical surface 360*d* of the first sliding sleeve 360 and the first recessed bore surface 316*c* and/or between the raised outer cylindrical surface 360*h* and the second recessed bore surface 316*e*. For example, in the embodiment of FIGS. 3A, 3B, and 3C the second sliding sleeve 360 further comprises one or more radial or concentric recesses or grooves configured to receive one or more suitable fluid seals such as fluid seals 367, for example, to restrict fluid movement via the interface between the sliding sleeve 360 and the second sliding sleeve recess 316. Suitable seals include but are not limited to a T-seal, an O-ring, a gasket, or combinations thereof.

In an embodiment, the housing 310 and the second sliding sleeve 360 may cooperatively define a fluid reservoir 320. For example, referring to FIGS. 3A, 3B, and 3C, the fluid reservoir 320 is substantially defined by the second recessed bore surface 316*e* of the second sliding sleeve recess 316, the intermediate shoulder 316*b* of the second sliding sleeve recess 316, the first outer cylindrical surface 360*d* of the second sliding sleeve 360, and the intermediate shoulder 360*e* of the second sliding sleeve 360.

In an embodiment, the fluid chamber 320 may be of any suitable size, as will be appreciated by one of skill in the art viewing this disclosure. For example, in an embodiment, a fluid chamber like fluid chamber 320 may be sized according to the position of the ASA of which it is a part in relation to one or more other similar orifices of other ASAs of the same ASA cluster. For example, in an ASA cluster comprising multiple ASAs, the furthest uphole of these ASA may comprise an fluid chamber of a first volume (e.g., the relatively largest volume), the second furthest uphole ASA may comprise a fluid chamber of a second volume (e.g., the second relatively largest volume), the third furthest uphole ASA may comprise a fluid chamber of a third volume (e.g., the third relatively largest volume), etc. For example, the first volume may be greater than the second volume and the second volume may be greater than the third volume.

In an embodiment, the first sliding sleeve 340 may be slidably movable between a first position and a second position with respect to the housing 310. Referring again to FIG. 3A, the first sliding sleeve 340 is shown in the first position. In the first position, the upper shoulder 340*e* of the raised portion of the first sliding sleeve 340 may abut and/or be located substantially adjacent to the upper shoulder 314*a* of the first sliding sleeve recess 314 and/or the lower orthogonal face 360*b* of the second sliding sleeve 360. When the first sliding sleeve 340 is in the first position, the first sliding sleeve 340 may be characterized as in its upper-most position relative to the housing 310. Referring again to FIGS. 3B and 3C, the first sliding sleeve 340 is shown in the second position. In the second position, the lower orthogonal face 340*b* of the first sliding sleeve 340 may abut and/or be located substantially adjacent to the lower shoulder 314*b* of the first sliding sleeve recess 314. When the first sliding sleeve 340 is in the second position, the first sliding sleeve 340 may be characterized as in its lower-most position relative to the housing 310.

In the embodiment of FIG. 3A where the first sliding sleeve 340 is in the first position, the first sliding sleeve 340 may be configured and/or positioned to disallow movement of the second sliding sleeve 360 from the first position to the second position as will be discussed herein. Particularly, when the first sliding sleeve 340 is in the first position, the second sliding sleeve 360 is retained in its first position and, when the first sliding sleeve 340 is in the second position, the second sliding sleeve 360 is not retained in the first position and, thus, is free to move downward. For example, even though the orifice 365 provides a route of fluid communication to the fluid chamber 320, the force exerted against the second sliding sleeve 360 will be insufficient to overcome opposing fluid forces against the first sliding sleeve (e.g., fluid pressure exerted against the lower orthogonal face 340*b*) and shear the shear-pin 348 retaining the first sliding sleeve 340.

In an embodiment, the second sliding sleeve 360 may be slidably movable between a first position and a second position with respect to the housing 310. Referring again to FIGS. 3A and 3B, the second sliding sleeve 360 is shown in the first position. In the first position, the upper orthogonal face 360*a* of the second sliding sleeve 360 may abut and/or be adjacent to the upper shoulder 316*a* of the second sliding sleeve recess 316 and/or the upper shoulder 360*e* of the second sliding sleeve 360 may be proximate to the intermediate shoulder 316*b* of the second sliding sleeve recess. When the second sliding sleeve 360 is in the first position, the second sliding sleeve 360 may be characterized as in its upper-most position relative to the housing 310. Referring again to FIG. 3C, the second sliding sleeve 360 is shown in the second position. In the second position, the lower shoulder 360*g* of the second sliding sleeve 360 may abut the lower shoulder 316*d* of the second sliding sleeve recess 316. When the second sliding sleeve 360 is in the second position, the second sliding sleeve 360 may be characterized as in its lower-most position relative to the housing 310.

In an embodiment, the second sliding sleeve 360 may be configured to allow or disallow fluid communication between the axial flowbore 311 of the housing and the exterior of the housing 310, dependent upon the position of the second sliding sleeve 360 relative to the housing 310. For example, in the embodiment of FIGS. 3A and 3B, when the second sliding sleeve 360 is in the first position, the second sliding sleeve 360 obstructs the ports 315 of the housing 310 and, thereby, restricts fluid communication via the ports 315. In the embodiment of FIG. 3C, when the second sliding sleeve 360 is in the second position, the second sliding sleeve 360 does not obstruct the ports 315 of the housing and, thereby allows fluid communication via the ports 315.

In an alternative embodiment, a second sliding sleeve like second sliding sleeve 360 comprises one or more ports suitable for the communication of fluid from the axial flowbore 311 of the housing 310 to an exterior of the housing when so-configured. For example, in such an embodiment, where the second sliding sleeve is in the first position, the ports within the second sliding sleeve are misaligned with the ports 315 of the housing and will not communicate fluid from the axial flowbore 311 to the exterior of the housing. Also, in such an embodiment, where the second sliding sleeve is in the second position, the ports within the second sliding sleeve are aligned with the ports 315 of the housing and will communicate fluid from the axial flowbore 311 to the exterior of the housing 310.

In an embodiment, the second sliding sleeve 360 may be retained in the first position and/or the second position by suitable retaining mechanism. For example, in an embodiment, the second sliding sleeve 360 may be retained in the first position and/or the second position by a snap-ring, a C-ring, a biased pin, ratchet teeth, or combinations thereof. Such a retaining mechanism may be carried in a suitable slot, groove, channel, bore, or recess in the second sliding sleeve 360, alternatively, in the housing 310, and may expand into and be received by a suitable slot groove, channel, bore, or recess in the housing 310, or, alternatively, in the second sliding sleeve 360.

In an embodiment where the ASA 300 is configured as a non-terminal ASA, the seat 380 may comprise an expandable seat. In an embodiment, such an seat 380 may be configured to receive, engage, and retain an obturating member (e.g., a ball or dart) of a given size and/or configuration moving via axial flowbore 311 when the seat 380 is in a narrower, non-expanded conformation and to release the obturating member when the seat 380 is in a larger, expanded conformation. In the embodiment of FIG. 3A, the expandable seat 380 is illustrated in such a narrower, non-expanded conformation and, in the embodiment of FIGS. 3B and 3C, the seat 380 is illustrated in an expanded conformation.

In an embodiment where the ASA 300 is configured as a terminal ASA, the seat 380 may comprise a non-expandable seat. Alternatively, as will be disclosed below, in embodiment where the ASA 300 is configured as a terminal ASA, the seat 380 may comprise an expandable seat as described herein above that is not allowed to expand into the expanded conformation.

In an embodiment, such an expandable and/or non-expandable seat may be configured similarly to seat 280, disclosed above with respect to FIGS. 2A, 2B, 2C, 4A, and 4B. In the embodiment of FIGS. 3A, 3B, and 3C, the seat 380 comprises a separate component from the first sliding sleeve 340. In an alternative embodiment, the seat 380 may be integrated within and/or coupled to the first sliding sleeve 340.

In an embodiment, the seat 380 may be slidably positioned within the housing 310. In the embodiment of FIGS. 3A, 3B, and 3C, the seat 380 is positioned uphole relative to the first sliding sleeve 340. In an embodiment, the seat 380 may be slidably movable between a first position and a second position with respect to the housing 310. Referring again to FIG. 3A, the seat 380 is shown in the first position. In the first position, the seat 380 may be contained within the second sliding sleeve 360, particularly, within the first sliding sleeve recess 364 of the second sliding sleeve, and, referring to FIGS. 3B and 3C, the seat 380 is shown in the second position.

In an embodiment where the ASA 300 is configured as a non-terminal ASA and, therefore, comprises an expandable seat 380, when the seat 380 is in the first position, seat 380 may be retained in the narrower, non-expanded conformation and, when the expandable seat 380 is in the second position, the expandable seat 380 may be allowed to expand into the larger, expanded conformation. For example, in the embodiment of FIG. 3A where the seat 380 is in the first position, the seat 380 is within a relatively narrower portion of the second sliding sleeve 360, and is therefore retained in the narrower, non-expanded conformation. In the embodiment of FIGS. 3B and 3C, where the seat 380 is in the second position, the seat 380 is in a relatively wider portion of the housing 310 (e.g., having a larger inside diameter), for example, the first sliding sleeve recess 314, and is therefore allowed to expand into the expanded conformation. In the embodiment of FIG. 3A where the seat 380 is in the first position, the seat 380 may be configured and/or positioned to engage and retain an obturating member (e.g., a ball or dart) moving via the axial flowbore 311, thereby creating a barrier to fluid communication via the axial flowbore 311. In the embodiment of FIGS. 3B and 3C where the expandable seat 380 has shifted downhole and is in the second position, the expandable seat 380 may be configured to release such an obturating member, thereby allowing the obturating member to move downward through the axial flowbore 311.

In embodiment where the ASA 300 is configured as a terminal ASA, when the seat 380 is the first position, the seat 380 may be retained in the narrower, non-expanded confirmation in both the first position and the second position. As such, the seat 380 may be configured and/or positioned to engage and retain an obturating member (e.g., a ball or dart) moving via the axial flowbore 311, thereby creating a barrier to fluid communication via the axial flowbore 311 and will not expand to release an obturating member that has engaged the seat 380.

One or more of embodiments of an ASA (e.g., ASA 200 and ASA 300) and a wellbore servicing system (e.g., wellbore servicing system 100) comprising one or more ASA clusters (e.g., ASA clusters 100A and 100B) having been disclosed, also disclosed herein are one or more embodiments of a wellbore servicing method employing such an ASA and/or wellbore servicing system comprising one or more ASA clusters. In an embodiment, a wellbore servicing method may generally comprise the steps of positioning at least one ASA cluster proximate to one or more zones of a subterranean formation, isolating adjacent zones of the subterranean formation (e.g., by setting one or more isolation devices, such as packers), transitioning the ASAs of a first ASA cluster from a first, deactivated mode or configuration to a second, delay mode or configuration, transitioning the ASAs of the first ASA cluster from the second, delay mode or configuration, to a third, activated mode or configuration, and communicating a servicing fluid from to the zone of the subterranean formation via the ASAs of the first ASA cluster. In an embodiment, a wellbore servicing method may additionally comprise transitioning the ASAs of a second ASA cluster from a first, deactivated mode or configuration to a second, delay mode or configuration, transitioning the ASAs of the second ASA cluster from the second, delay mode or configuration, to a third, activated mode or configuration, and communicating a servicing fluid from to the zone of the subterranean formation via the ASAs of the second ASA cluster.

Referring again to FIG. 1, in an embodiment, one or more ASA clusters, such as the first ASA cluster 100A and/or the second ASA cluster 100B, may be incorporated within a workstring such as workstring 112, for example, as disclosed herein above. The workstring 112 may be positioned within a wellbore such as wellbore 114 such that the first ASA cluster 100A is proximate and/or substantially adjacent to the first subterranean formation zone 102A and the second ASA cluster 100B is proximate and/or substantially adjacent to the second subterranean formation zone 102B. In an embodiment, the ASAs (e.g., ASAs 200A of the first ASA cluster 100A and ASAs 200B of the second ASA cluster 100B) may be positioned within the wellbore 114 in a first, deactivated mode or configuration (e.g., in a configuration in which no ASA will communicate fluid to the subterranean formation).

In an embodiment, the ASAs may be substantially similar to ASA 200 and/or ASA 300, as disclosed herein. Also, in an embodiment, each ASA cluster may comprise one or more ASAs configured as a non-terminal ASAs and one ASAs configured as a terminal ASA. In such an embodiment, the ASA configured as a terminal ASA may be positioned downhole relative to the non-terminal ASAs of the same ASA cluster. For example, within each ASA cluster (e.g., ASA cluster 100A and/or ASA cluster 100B) the terminal ASA may be the furthest downhole and the non-terminal ASA(s) may be located uphole relative to the ASA configured as a terminal ASA.

In an embodiment, the ASAs of the same ASA cluster may be configured to engage an obturating member of a given size and/or configuration. For example, all ASAs of the first ASA cluster may be configured to engage an obturating member of a first size and/or configuration while all ASAs of the second ASA cluster may be configured to engage an obturating member of a second size and/or configuration. In an embodiment, as will be disclosed herein, progressively further downhole ASA clusters may be configured to engage obturating members having progressively smaller sizes (e.g., the ASAs of the second ASA cluster 100B may be configured to engage smaller obturating members than the ASAs of the first ASA cluster 100A).

In an embodiment, the first zone 102A may be isolated from the second zone 102B. For example, in the embodiment of FIG. 1, the first zone 102A is separated from the second zone 102B via the operation of a suitable wellbore isolation device 130. Suitable wellbore isolation devices are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof.

In an embodiment, the first ASA cluster 100A and the second ASA cluster 100B having been positioned within the wellbore 114 and, optionally, adjacent zones of the subterranean formation (e.g., zones 102A and 102B) having been isolated, one of the clusters (e.g., the first ASA cluster 100A or the second ASA cluster 100B) may be prepared for the communication of fluid to the proximate and/or adjacent zone (e.g., zones 102A and 102B).

In an embodiment, the zones of the subterranean formation 102A, 102B may be serviced working from the zone that is furthest downhole zone (e.g., in the embodiment of FIG. 1, the second zone 102B) progressively upward toward the least downhole zone (e.g., in the embodiment of FIG. 1, the first zone 102A).

In such an embodiment, the ASAs 200B (which may be configured substantially similar to ASA 200 disclosed with reference to FIGS. 2A, 2B, and 2C and/or to ASA 300 disclosed with reference to FIGS. 3A, 3B, and 3C) of the second ASA cluster 100B (which are positioned proximate and/or substantially adjacent to the second zone 102B) are transitioned from the first, deactivated mode or configuration to the second, delay mode or configuration.

In an embodiment, transitioning the ASA 200B to the second, delay mode or configuration may comprise introducing an obturating member (e.g., a ball or dart) configured to engage the seat (e.g., seat 280 and/or seat 380) of the ASAs 200B into the workstring 112 and forward-circulating the obturating member to engage the seat 280 and/or 380 of the further uphole of the ASAs 200B of the second ASA cluster 100B. In the embodiment of FIG. 1, because the ASAs of the first ASA cluster 100A (e.g., ASAs 200A) are incorporated within the workstring 112 uphole from the ASAs of the second ASA cluster 100B (e.g., ASAs 200B) an obturating member configured to engage the seat 280 and/or seat 380 of the ASAs 200B may also be configured to pass through the ASA 200A without engaging or being retained by the seat 280 and/or seat 380 therein. For example, where the obturating member comprises a ball, the ball may be smaller in diameter than the inner bore diameter of the seats (e.g., such as seat 280) of the ASAs 200A.

In an embodiment, when the obturating member has engaged the seat 280 or 380 of the relatively furthest uphole of the ASAs 200B of the second ASA cluster 100B (which may be configured as a non-terminal ASA), continuing to pump fluid may increase the force applied to the sliding sleeve 240 or 340 via the seat and the obturating member. For example, application of force to the first sliding sleeve 240 or 340 via the seat 280 or 380 may cause shear pins 248 or 348 to shear and the first sliding sleeve 240 or 340 and the seat 280 or 380 to slidably move from their first positions (e.g., as shown in FIGS. 2A and/or 3A) to their second positions (e.g., as shown in FIGS. 2B and/or 3B).

In an embodiment where the ASA is configured substantially similar to ASA 200 disclosed herein, in the second position of FIG. 2B, the first sliding sleeve 240 provides a route of fluid communication via orifice 245 to the fluid reservoir 220.

In an alternative embodiment where the ASA is configured substantially similar to ASA 300 disclosed herein, in the second position of FIG. 3B, the first sliding sleeve 340 will no longer retain the second sliding sleeve 360 in the first position, that is, movement of the first sliding sleeve 340 will allow the second sliding sleeve 360 to be moved from the first position via fluid flow into fluid reservoir 320 via orifice 365.

As the seat 280 or 380 moves from the first position to the second position, the seat 280 or 380 is allowed to expand into its expanded conformation, thereby releasing the obturating member which continues to move downhole until it engages the seat 280 or 380 of the next (adjacent, relatively downhole) ASA 200B. As such, the furthest uphole ASA 200B of the second ASA cluster 100B is transitioned to the second, delayed mode or configuration.

In an embodiment, the obturating member continues to move down hole until it reaches the next (e.g., the second furthest) uphole ASA 200B of the second ASA cluster 100B. Upon reaching the second furthest uphole ASA 200B, the obturating member engages the seat 280 or 380 and the second furthest uphole ASA 200B of the second ASA cluster 100B may be transitioned to the second, delay mode or configuration as was the furthest uphole ASA 200B of the same cluster. In an embodiment where the second furthest uphole ASA 200B is configured as a non-terminal ASA, the obturating member will be released and continue to move downward through the work string 112 transitioning all ASAs of the second ASA cluster 100B to the second, delay mode or configuration.

Alternatively, if the second furthest uphole ASA 200B is configured as a terminal ASA, or when the obturating member reaches an ASA configured as a terminal ASA, (the furthest downhole ASA of a given ASA cluster), the obturating member will engage the seat 280 or 380 of the ASA and, similarly, the terminal ASA will be transitioned to the second, delayed mode or configuration. Upon transitioning to the second, delayed mode or configuration the terminal ASA will not release the obturating member. As such, the obturating member, which continues to engage the seat 280 or 380, will provide a barrier to fluid communication beyond the terminal ASA.

In an embodiment, once the ASAs of a given ASA cluster (e.g., ASAs 200B of the second ASA cluster 100B) have been transitioned to the second, delayed mode or configuration, the ASAs may then be transitioned from the second, delayed mode or configuration to the third, activated mode or configuration. In an embodiment, transitioning the ASAs to the third, activated mode or configuration may comprise applying fluid pressure to the axial flowbore 211 or 311.

For example, in an embodiment where the ASA's are configured substantially similar to ASA 200 disclosed with respect to FIGS. 2A, 2B, and 2C, when the first sliding sleeve 240 is in the second position, orifice 245 provides a route of fluid communication to the fluid chamber 220. In such an embodiment, the application of fluid pressure to axial flowbore 211 may cause fluid to flow into the fluid chamber 220 via orifice 245. As fluid flows into the fluid chamber 220, the fluid exerts a fluid pressure against the second sliding sleeve 260. Particularly, as shown in the embodiment of FIGS. 2B and 2C, the fluid exerts a fluid pressure against upper orthogonal face 260*a* of the second sliding sleeve 260. The fluid pressure applies a downward force to the second sliding sleeve 260, causing the shear pin(s) 268 to shear and the second sliding sleeve 260 to move downward within the housing 210. As will be appreciated by one of skill in the art viewing this disclosure, the force applied to the second sliding sleeve 260 may be calculated based upon the differences in fluid pressure acting in the upward and downward directions and the differences in the area of the upward and downward facing surfaces of the second sliding sleeve 260 upon which the fluid pressures will act.

As the second sliding sleeve 240 moves downward within the housing 210, fluid continues to flow into the fluid chamber 220 via orifice 245 until the upper orthogonal face 260*a* of the second sliding sleeve 260 moves beyond the lower orthogonal face 240*b* of the first sliding sleeve 240, at which point fluid from the axial flowbore 211 may apply a force directly to the upper orthogonal face 260*a* of the second sliding sleeve 260. The second sliding sleeve 260 continues to move downward within the housing 210 until the lower shoulder 260*e* of the second sliding sleeve 260 abuts the lower shoulder 216*b* of the second sliding sleeve recess 216. As such, the second sliding sleeve 260 may be moved into the second position. The snap-ring 269 may expand into a complementary groove or slot to retain the housing in the second position. In the second position, the second sliding sleeve 260 no longer obstructs the ports 215 and, as such, fluid may be communicated via the one or more ports 215. As such, the ASAs of the second ASA cluster 100B may be transitioned from the second, delay mode or configuration to the third, activated mode or configuration. In an alternative embodiment, a second sliding sleeve like sliding sleeve 260 may similarly be configured to move upward within a housing like housing 210.

Alternatively, in an embodiment where the ASA's are configured substantially similar to ASA 300 disclosed with respect to FIGS. 3A, 3B, and 3C, when the first sliding sleeve 340 is in the second position, the second sliding sleeve 360 is not retained in the first position. In such an embodiment, the application of fluid pressure to axial flowbore 311 may cause fluid to flow into the fluid chamber 320 via orifice 365, which provides a route of fluid communication between the axial flowbore 311 and the fluid chamber 320. As fluid flows into the fluid chamber 320, the fluid exerts a fluid pressure against the second sliding sleeve 360. Particularly, as shown in the embodiment of FIGS. 3B and 3C, the fluid exerts a fluid pressure against the upper shoulder 360*e*. The fluid pressure applies a downward force to the second sliding sleeve 360, the second sliding sleeve 360 to move downward within the housing 310. As will be appreciated by one of skill in the art viewing this disclosure, the force applied to the second sliding sleeve 360 may be calculated based upon the differences in fluid pressure acting in the upward and downward directions and the differences in the area of the upward and downward facing surfaces of the second sliding sleeve 360 upon which the fluid pressures will act. As the second sliding sleeve 340 moves downward within the housing 310, fluid continues to flow into the fluid chamber 320 via orifice 365 until the lower shoulder 360*g* of the second sliding sleeve 360 abuts the lower shoulder 316*d* of the second sliding sleeve recess 316. As such, the second sliding sleeve 360 may be moved into the second position. In an embodiment, a snap-ring may expand into a complementary groove or slot to retain the housing in the second position. In the second position, the second sliding sleeve 360 no longer obstructs the ports 315 and, as such, fluid may be communicated via the one or more ports 315. As such, the ASAs of the second ASA cluster 100B may be transitioned from the second, delay mode or configuration to the third, activated mode or configuration.

In an embodiment, the second sliding sleeve 260 or 360 of each ASA in a given cluster may be configured to transition from the first position to the second position within a predetermined amount of time. For example, various characteristics of the ASAs and/or operational parameters can be adjusted to allow for a predetermined amount of time for the second sliding sleeve 260 or 360 to transition from the first position to the second position. The amount of time necessary to transition the second sliding sleeve 260 or 360 from the first position to the second position may vary dependent upon the size and/or configuration of orifice 245 or 365, the size of fluid chamber 220 or 320, the viscosity of the fluid, the temperature of the fluid, the pressure of the fluid, the presence or absence of particulate material in the fluid, the flow-rate of the fluid, or combinations thereof. For example, an ASA like ASA 200 or 300 may be configured and/or one or more of the above-listed operational parameters may be maintained such that a second sliding sleeve like second sliding sleeve 260 or 360 will transition from the first position to the second position, thereby transitioning the ASA from the second, delay mode or configuration to the third, activated mode or configuration within about 30 seconds, alternatively, within about 60 seconds, alternatively, within about 90 seconds, alternatively, within about 2 minutes, alternatively, within about 5 minutes, alternatively, within about 10 minutes, alternatively, within about 20 minutes from the time at which the ASA is transitioned to the second, delay mode or configuration. In an embodiment, an ASA like ASA 200 or 300 may be configured and/or one or more of the above-listed operational parameters may be maintained such that the relatively uphole located ASA(s) to have a longer delay periods before transitioning the ASA from the second, delay mode or configuration to the third, activated mode or configuration as compared to the delay period provided by the relatively downhole located ASAs. For example, the volume of the fluid chamber 220 or 320, the orifice 245 or 365, and/or other features of the relatively uphole located ASA(s) may be chosen differently and/or in different combinations from the related components of the relatively downhole ASA(s) in order to adequately delay provision of the above-described fluid communication until the all ASAs of a given ASA cluster have been transitioned into a delay mode of operation. In an embodiment, the ASAs of a given ASA cluster may be configured such that the second sliding sleeve 260 or 360 of a given ASA does not transition from the first position to the second position until the first sliding sleeves 240 or 340 of all ASA of that ASA cluster have been transitioned from the first position to the second position. That is, the ASAs may be configured such that no ASA will transition from the second mode to the third mode until all ASAs of that ASA cluster have been transitioned at least from the first mode to the second mode.

In an embodiment, once the ASAs of the second ASA cluster 100B have been transitioned from the second, delay mode or configuration to the third, activated mode or configuration, a suitable wellbore servicing fluid may be communicated to the second subterranean formation zone 102B via the ports 215 or 315 of the activated ASAs 200B. Nonlimiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure. For example, the wellbore servicing fluid may be communicated at a rate and/or pressure sufficient to initiate or extend a fluid pathway (e.g., a perforation and/or a fracture) within the subterranean formation 102.

In an embodiment, once the servicing operation has been completed with respect to the second subterranean formation zone 102B, the servicing operation with respect to the first subterranean formation zone 102A may commence. In an embodiment, the servicing operation with respect to the first subterranean formation zone 102A may progress by substantially the same methods as disclosed with respect to the second subterranean formation zone 102B. In an embodiment where the servicing operation progresses from the zone that is furthest downhole zone (e.g., in the embodiment of FIG. 1, the second zone 102B) progressively upward toward the least downhole zone (e.g., in the embodiment of FIG. 1, the first zone 102A) and in an embodiment where the furthest downhole ASA of an ASA cluster is configured as a terminal ASA, it may be unnecessary to close and/or isolate an ASA cluster (e.g., ASA cluster 100B) after the servicing operation has been completed with respect to that cluster. For example, because an obturating member will engage a seat like seat 280 or 380 within a terminal ASA (e.g., 200A) in the cluster (e.g., 100A) above (uphole from) a lower ASA cluster (e.g., 100B) the obturating member may restrict the passage of fluid to those downhole ASAs (e.g., ASAs 200B of cluster 100B) that remain in an activated configuration.

In an alternative embodiment, it may be desirable to inactive one or more ASAs in an ASA cluster after the servicing operation has been completed with respect to that ASA cluster. In an embodiment, it may be possible to transition the ASAs in an ASA cluster from the activated configuration to an inactivated configuration via the operation of a wireline tool, a mechanical shifting tool, or the like. For example, such a wireline tool or mechanical shifting tool may be employed to engage a second sliding sleeve like second sliding sleeve 260 or 360 and inactivate the ASA by positioning that second sliding sleeve such that the ports are closed (e.g., misaligned).

In an embodiment, an ASA cluster such as ASA cluster 100A or 100B, and/or ASA such as ASA 200 or ASA 300 may be advantageously employed in the performance of a wellbore servicing operation. For example, the ability to transition multiple ASAs (e.g., within a given ASA cluster) with only a single ball or dart, as disclosed herein, may improve the efficiency of such a servicing operation by decreasing the number of balls or darts that must be communicated downhole to transition a downhole tool from a first configuration to a second configuration and/or by reducing the number and/or size of restrictions to the flowbore of the work string. For example, the ability to selectively transition a sliding sleeve (e.g., a second sliding sleeve like second sliding sleeve 260 or 360) via the pressure of the servicing fluid may alleviate the need to communicate one or more additional obturating members downhole to the ASAs for the same purpose. Further, the ability to transition multiple ASAs to an activated configuration by communicating a single obturating member, thereby simultaneously or nearly simultaneously activating multiple ASAs within a given ASA cluster, may allow an operator to advantageously communicate a high volume of stimulation fluid to a given zone of a subterranean formation, for example, in the performance of a high-rate fracturing operation.

ADDITIONAL DISCLOSURE

The following are nonlimiting, specific embodiments in accordance with the present disclosure:

Embodiment A. An activatable wellbore servicing apparatus, comprising:

a housing, the housing generally defining an axial flowbore and comprising one or more ports;

a first sliding sleeve;

a second sliding sleeve, wherein the second sliding sleeve is movable relative to the housing from (a) a first position in which the second sliding sleeve obstructs fluid communication from the axial flowbore to an exterior of the housing via the one or more ports of the housing to (b) a second position in which the second sliding sleeve allows fluid communication from the axial flowbore to the exterior of the housing via the one or more ports of the housing, and wherein the first sliding sleeve is movable relative to the housing from (a) a first position in which the first sliding sleeve does not allow a fluid pressure applied to the axial flowbore to move the second sliding sleeve from the first position to the second position to (b) a second position in which the first sliding sleeve allows a fluid pressure applied to the axial flowbore to move the second sliding sleeve from the first position to the second position; and an expandable seat.

Embodiment B. The activatable wellbore servicing apparatus of Embodiment A, wherein the housing, the first sliding sleeve, and the second sliding sleeve cooperatively define a fluid chamber.

Embodiment C. The activatable wellbore servicing apparatus of Embodiment B, wherein the first sliding sleeve comprises an orifice, wherein, when the first sliding sleeve is in the first position, the orifice does not provide a route of fluid communication between the axial flowbore and the fluid chamber, and wherein, when the first sliding sleeve is in the second position, the orifice provides a route of fluid communication between the axial flowbore and the fluid chamber.

Embodiment D. The activatable wellbore servicing apparatus of one of Embodiments B through C, wherein a fluid pressure applied within the fluid chamber causes the second sliding to move from the first position to the second position.

Embodiment E. The activatable wellbore servicing apparatus of one of Embodiments B through D, wherein the first sliding sleeve is retained in the first position by a sheer pen.

Embodiment F. The activatable wellbore servicing apparatus of one of Embodiments B through E, wherein the second sliding sleeve is retained in the second position by a snap-ring.

Embodiment G. The activatable wellbore servicing apparatus of Embodiment A, wherein the housing and the second sliding sleeve cooperatively define a fluid chamber.

Embodiment H. The activatable wellbore servicing apparatus of Embodiment G, wherein the second sliding sleeve comprises an orifice that provides a route of fluid communication between the axial flowbore and the fluid chamber.

Embodiment I. The activatable wellbore servicing apparatus of on of Embodiments G through H, wherein a fluid pressure applied within the fluid chamber causes the second sliding to move from the first position to the second position.

Embodiment J. The activatable wellbore servicing apparatus of one of Embodiments G through I, wherein the first sliding sleeve is retained in the first position by a sheer pen.

Embodiment K. The activatable wellbore servicing apparatus of one of Embodiments A through J, wherein the expandable seat is movable between (a) a first position in which the expandable seat is retained in a narrow conformation and (b) a second position in which the expandable seat is allowed to expand into an expanded conformation.

Embodiment L. A system for servicing a wellbore comprising a workstring disposed within the wellbore, the workstring comprising:

a first wellbore servicing apparatus, comprising:

a first housing, the first housing generally defining a first axial flowbore and comprising a first one or more ports;

a first sliding sleeve;

a second sliding sleeve, wherein the second sliding sleeve is movable relative to the first housing from (a) a first position in which the second sliding sleeve obstructs fluid communication from the first axial flowbore to an exterior of the first housing via the first one or more ports of the first housing to (b) a second position in which the second sliding sleeve allows fluid communication from the first axial flowbore to the exterior of the first housing via the first one or more ports of the first housing, and wherein the first sliding sleeve is movable relative to the first housing from (a) a first position in which the first sliding sleeve does not allow a fluid pressure applied to the first axial flowbore to move the second sliding sleeve from the first position to the second position to (b) a second position in which the first sliding sleeve allows a fluid pressure applied to the first axial flowbore to move the second sliding sleeve from the first position to the second position; and an expandable seat being movable between (a) a first position in which the expandable seat is retained in a narrow conformation and (b) a second position in which the expandable seat is allowed to expand into an expanded conformation; and a second wellbore servicing apparatus, comprising:

a second housing, the second housing generally defining a second axial flowbore and comprising a second one or more ports;

a third sliding sleeve;

a fourth sliding sleeve, wherein the fourth sliding sleeve is movable relative to the second housing from (a) a first position in which the fourth sliding sleeve obstructs fluid communication from the second axial flowbore to an exterior of the second housing via the second one or more ports of the second housing to (b) a second position in which the fourth sliding sleeve allows fluid communication from the second axial flowbore to the exterior of the second housing via the second one or more ports of the housing, and wherein the third sliding sleeve is movable relative to the second housing from (a) a first position in which the third sliding sleeve does not allow a fluid pressure applied to the second axial flowbore to move the fourth sliding sleeve from the first position to the second position to (b) a second position in which the third sliding sleeve allows a fluid pressure applied to the second axial flowbore to move the fourth sliding sleeve from the first position to the second position; and a non-expandable seat being movable between (a) a first position and (b) a second position.

Embodiment M. The system of Embodiment L, wherein the first wellbore servicing apparatus and the second wellbore servicing apparatus are positioned within the wellbore substantially adjacent to a first formation zone.

Embodiment N. The system of one of Embodiments L through M, wherein first wellbore servicing apparatus is incorporated within the workstring uphole from the second wellbore servicing apparatus.

Embodiment O. The system of one of Embodiments L through N, further comprising an obturating member configured (a) to engage and be retained by the expandable seat when the expandable seat is in the first position, (b) to be released by the expandable seat when the expandable seat is in the second the position, and (c) to engage in be retained by the non-expandable seat in both the first position and the second position.

Embodiment P. A method of servicing a wellbore penetrating a subterranean formation comprising:

positioning a workstring with in a wellbore, the workstring substantially defining a workstring flowbore and comprising:

a first wellbore servicing apparatus comprising a first one or more ports; and a second wellbore servicing apparatus comprising a second one or more ports, each of the first wellbore servicing apparatus and the second wellbore servicing apparatus being transitionable from a locked mode to a delay mode and from the delay mode to an activated mode, wherein, when in both the locked mode and the delay mode, the first wellbore servicing apparatus will not communicate fluid via the first one or more ports and the second wellbore servicing apparatus will not communicate fluid via the second one or more ports, and wherein, when in the activated mode the first wellbore servicing apparatus will communicate fluid via the first one or more ports and the second wellbore servicing apparatus will communicate fluid via the second one or more ports;

transitioning the first wellbore servicing apparatus and the second wellbore servicing apparatus from the locked mode to the delay mode;

transitioning the first wellbore servicing apparatus and the second wellbore servicing apparatus from the delay mode to the activated mode, wherein the first wellbore servicing apparatus does not transition to the activated mode before the second wellbore servicing apparatus is in the locked mode;

communicating a wellbore servicing fluid to a first zone of the subterranean formation via the first one or more ports and the second one or more ports.

Embodiment Q. The method of Embodiment P, wherein transitioning the first wellbore servicing apparatus and the second wellbore servicing apparatus from the locked mode to the delay mode comprises:

introducing a first obturating member into the workstring;

forward-circulating the first obturating member to engage a first seat within the first wellbore servicing apparatus;

applying a fluid pressure to the first seat via the first obturating member, wherein the fluid pressure causes the first wellbore servicing apparatus to transition from the locked mode to the delay mode and to release the first obturating member;

forward-circulating the first obturating member to engage a second seat within the second wellbore servicing apparatus;

applying a fluid pressure to the second seat via the first obturating member, wherein the fluid pressure causes the second wellbore servicing apparatus to transition from the locked mode to the delay mode.

Embodiment R. The method of one of Embodiments P through Q, wherein transitioning the first wellbore servicing apparatus and the second wellbore servicing apparatus from the delay mode to the activated mode comprises applying a fluid pressure to the workstring flowbore for a predetermined amount of time.

Embodiment S. The method of one of Embodiments P through R, wherein the wellbore servicing fluid comprises a fracturing fluid, a perforating fluid, an acidizing fluid, or combinations thereof.

Embodiment T. The method of one of Embodiments P through S, wherein the workstring further comprises:

a third wellbore servicing apparatus comprising a third one or more ports; and a fourth wellbore servicing apparatus comprising a fourth one or more ports, each of the third wellbore servicing apparatus and the fourth wellbore servicing apparatus being transitionable from a locked mode to a delay mode and from the delay mode to an activated mode, wherein, when in both the locked mode and the delay mode, the third wellbore servicing apparatus will not communicate fluid via the third one or more ports and the fourth wellbore servicing apparatus will not communicate fluid via the fourth one or more ports, and wherein, when in the activated mode the third wellbore servicing apparatus will communicate fluid via the third one or more ports and the fourth wellbore servicing apparatus will communicate fluid via the fourth one or more port, wherein both the third wellbore servicing apparatus and the fourth wellbore servicing apparatus are positioned uphole from both the first wellbore servicing apparatus and the fourth wellbore servicing apparatus, and wherein the third wellbore servicing apparatus and the fourth wellbore servicing apparatus are positioned substantially.

Embodiment U. The method of Embodiment T, further comprising the steps of:

after communicating the wellbore servicing fluid to the first zone of the subterranean formation via the first one or more ports and the second one or more ports, transitioning the third wellbore servicing apparatus and the fourth wellbore servicing apparatus from the locked mode to the delay mode;

transitioning the third wellbore servicing apparatus and the fourth wellbore servicing apparatus from the delay mode to the activated mode, wherein the third wellbore servicing apparatus does not transition to the activated mode before the fourth wellbore servicing apparatus is in the locked mode;

communicating a wellbore servicing fluid to a second zone of the subterranean formation via the third one or more ports and the fourth one or more ports.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An activatable wellbore servicing apparatus, comprising;

a housing, the housing generally defining an axial flowbore and comprising one or more ports;

a first sliding sleeve;

a second sliding sleeve, wherein at least a portion of the first sliding sleeve is telescopically positioned within at least a portion of the second sliding sleeve, wherein the second sliding sleeve is movable, relative to the housing from (a) a first position in which the second sliding sleeve obstructs fluid communication from the axial flowbore to an exterior of the housing via the one or more ports of the housing to (b) a second position in which the second sliding sleeve allows fluid communication from the axial flowbore to the exterior of the housing via the one or more ports of the housing, and wherein the first sliding sleeve is movable relative to the housing from (a) a first position in which the first sliding sleeve does not allow a fluid pressure applied to the axial flowbore to move the second sliding sleeve from the first position to the second position to (b) a second position in which the first sliding sleeve allows a fluid pressure applied to the axial flowbore to move the second sliding sleeve from the first position to the second position; and an expandable seat.

2. The activatable wellbore servicing apparatus of claim 1, wherein the housing, the first sliding sleeve, and the second sliding sleeve cooperative define a fluid chamber.

3. The activatble wellbore servicing apparatus of claim 2, wherein the first sleeve comprises an orifice, wherein, when the first sliding sleeve is in the first position, the orifice does not provide a route, of fliud communication between the axial flowbore and the fluid chamber, and wherein, when the first sliding sleeve is in the second position, the orifice provides a route of fluid communication between the axial flowbore and the fluid chamber.

4. The activatable wellbore servicing apparatus of claim 2, wherein a fluid pressure applied within the fluid chamber causes the second sliding to move from the first position to the second position.

5. The activatable welbore servicing apparatus of claim 2, wherein the first sliding sleeve is retained in the first position by a shear pen.

6. The activatable wellbore servicing apparatus of claim 2, wherein the second sliding sleeve is retained in the second position by a snap-ring.

7. The activatable wellbore servicing apparatus of claim 1, wherein the housing and the second sliding sleeve cooperatively define a fluid chamber.

8. The activatable wellbore servicing apparatus of claim 7, wherein the second sliding sleeve comprises an orifice that provides a route of fluid communication between the axial flowbore and the fluid chamber.

9. The activatable wellbore servicing apparatus a claim 8, wherein a fluid pressure applied within the fluid chamber causes the second sliding to move from the first position to the second position.

10. The activatable wellbore servicing apparatus of claim 7, wherein the first sliding sleeve is retained in the first position by a sheer pen.

11. The activatable wellbore servicing apparatus of claim 1, wherein the expandable seat is movable between (a) a first position in which the expandable seat is retained in a narrow conformation and (b) a second position in which the expandable seat is allowed to expand into an expanded conformation.

12. A system for servicing a wellbore comprising a workstring disposed within the wellbore, the workstring comprising:

a first wellbore servicing apparatus, comprising:

a first housing, the first housing generally defining a first axial flowbore and comprising a first one or more ports;

a first sliding sleeve;

a second sliding sleeve, wherein at least a portion of the first sliding sleeve is telescopically positioned within at least a portion of the second sliding sleeve, wherein the second sliding sleeve is movable relative to the first housing from (a) a first position in which the second sliding sleeve obstructs fluid communication from the first axial flowbore to an exterior of the first housing via the first one or more ports of the first housing to (b) a second position in which the second sliding sleeve allows fluid communication from the first axial fiowbore to the exterior of the first housing via the first one or more poqs of the first housing, and wherein the first sliding sleeve is movable relative to the first housing from (a) a first position in which the first sliding sleeve does not allow a fluid pressure applied to the first axial flowbore to move the second sliding sleeve, from the first position to the second position to (b) a second position in which the first sliding sleeve allows a fluid pressure. applied to the first axial flowbore to move the second sliding sleeve from the first position to the second position; and an expandable seat being movable between (a) a first position in which the expandable seat is retained in a narrow conformation and (b) a second position in which the expandable seat is allowed to expand into an expanded conformation; and a second wellbore servicing apparatus, comprising;

a second housing, the second housing generally defining a second axial flowbore and comprising a second one or more ports;

a third sliding sleeve;

a fourth sliding sleeve, wherein at least a portion of the third sliding sleeve is telescopically positioned within at least a portion of the fourth sliding sleeve, wherein the fourth sliding sleeve is movable relative to the second housing from (a) a first position in which the fourth sliding sleeve obstructs fluid communication from the second axial flowbore to an exterior of the second housing via the second one or more ports of the second housing to (b) a second position in which the fourth sliding sleeve allows fluid communication from the second axial flowore to the exterior of the second housing via the second one or more ports of the housing, and wherein the third sliding sleeve is movable relative to the second housing from (a) a first position in which the third sliding sleeve does not allow a fluid pressure applied to the second axial flowbore to move the fourth sliding sleeve from the first position to the second position to (b) a second position in which the third sliding sleeve allows a fluid pressure applied to the second axial flowbore to move the fourth sliding sleeve from the first position to the second position; and a non-expandable seat being movable between (a) a first position and (b) a second position.

13. The system of claim 12, wherein the first wellbore servicing apparatus and the second wellbore servicing apparatus are positioned within the wellborn substantially adjacent to a first formation zone.

14. The system of claim 12, wherein first the wellbore servicing apparatus is incorporated within the workstring uphole from the second wellbore servicing apparatus.

15. The system of claim 12, further comprising an obturating member configured (a) to engage and be retained by the expandable seat when the expandable seat is in the first position, (b) to be released be the expandable seat when the expandable seat is in the second the position, and (c) to engage in be retained by the non-expandable seat in both the first position and the second position.

16. A method of servicing a wellbore penetrating a subterranean formation comprising:

positioning a workstring with in a wellbore, the workstring substantially defining a workstring flowbore and comprising;

a first wellbore servicing apparatus comprising a first one or more ports, a first sliding sleeve, and a second sliding sleeve; and a second wellbore servicing apparatus comprising a second one or more ports, a third sliding sleeve, and a fourth sliding sleeve, each of the first wellbore servicing apparatus and the second wellbore servicing apparatus being transitionable from a locked mode to a delay mode and from the delay mode to a activated mode, wherein, when in the locked mode, the second sliding sleeve will obstruct fluid communication via the first one or more ports, the first sliding sleeve will not allow fluid pressure applied to the workstring flowbore to move the second sliding sleeve, the fourth sliding sleeve will obstruct fluid communication via the second one or more ports, and the third sliding sleeve will not allow fluid pressure applied to the workstring flowbore to move the fourth sliding sleeve, wherein, when in the delay mode, the second sliding sleeve will obstruct fluid communication via the first one or more ports, the first sliding sleeve will allow fluid pressure applied to the workstring flowbore to move the second sliding sleeve, the fourth sliding sleeve will obstruct fluid communication via the second one or more ports, the third sliding sleeve will allow fluid pressure applied to the workstring flowbore to move the fourth sliding sleeve, and wherein, when in the activated mode the second sliding sleeve will allow fluid communication via the first one or more ports, and the fourth sliding sleeve will allow fluid communication via the second one or more ports;

transitioning the first wellbore servicing apparatus and the second wellbore servicing apparatus from the locked mode to the delay mode;

transitioning the first wellbore servicing apparatus and the second wellbore servicing apparatus from the delay mode to the activated mode, wherein the first wellbore servicing apparatus does not transition to the activated mode before die second wellbore servicing apparatus is in the delay mode;

communicating a wellbore servicing fluid to a first zone of the subterranean formation via the first one or more ports and the second one or more ports.

17. The method d claim 16, wherein transitioning the first wellborn servicing apparatus and the second wellborn servicing apparatus from the locked mode to the delay mode comprises:

introducing a first obturating member into the workstring;

forward-circulating the first obturating member to engage a first seat within the first wellbore servicing apparatus;

applying a fluid pressure to the first seat via the first obturating member, wherein the fluid pressure causes the first wellbore servicing apparatus to transition from the locked mode to the delay mode and to release the first obturating member;

forward-circulating the first obtutating member to engage a second seat within the second wellbore servicing apparatus;

applying a fluid pressure to the second seat via the first obturating member, wherein the fluid pressure causes the second wellbore servicing apparatus to transition from the locked mode to the delay mode.

18. The method of claim 17, wherein transitioning the first wellbore servicing apparatus and the second wellbore servicing apparatus from the delay mode to the activated mode comprises applying a fluid pressure to the workstring flowbore for a predetermined amount of time.

19. The method of claim 16, wherein the wellbore servicing fluid comprises a fracturing fluid, a perforating fluid, an acidizing, or combinations thereof.

20. The method of claim 16, wherein the workstring further comprises:

a third wellbore servicing apparatus comprising a third one or more ports; and a fourth Wellbore servicing apparatus comprising is fourth one or more ports, each of the third wellbore servicing apparatus and the fourth wellbore servicing apparatus being transitionable from a locked mode to a delay mode and from the delay mode to an activated mode, wherein, when in both the locked mode and the delay mode, the third wellbore servicing apparatus will not communicate fluid via the third one or more ports and the fourth wellbore servicing apparatus will not communicate fluid via the fourth one or more ports, and wherein, when in the activated mode the third wellbore servicing apparatus will communicate fluid via the third one or more ports and the fourth wellbore servicing apparatus will communicate fluid via the fourth one or more port, wherein both the third wellbore servicing apparatus and the fourth wellbore servicing apparatus are positioned uphole from both the first wellbore servicing apparatus and the second wellbore servicing apparatus, and wherein the third wellbore servicing apparatus and the fourth wellbore servicing apparatus are positioned substantially adjacent to a second formation zone.

21. The method of claim 20, further comprising the steps of:

after communicating the wellbore servicing fluid to the first zone of the subterranean formation via the first one or mere ports and the second one or more ports, transitioning the third wellbore servicing apparatus and the fourth wellbore servicing apparatus from the locked mode to the delay mode;

transitioning the third wellbore servicing apparatus and the fourth wellbore servicing apparatus from the delay mode to the activated mode, wherein the third wellbore servicing apparatus does transition to the activated mode before the fourth wellbore servicing apparatus is in the locked mode;

communicating a wellbore servicing fiuid to the second formation zone via the third one or more ports and the fourth one or more ports.

* * * * *